US007339557B2

(12) United States Patent
Ochi

(10) Patent No.: US 7,339,557 B2
(45) Date of Patent: Mar. 4, 2008

(54) DISPLAY APPARATUS

(75) Inventor: Yutaka Ochi, Yokohama (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 678 days.

(21) Appl. No.: 10/809,616

(22) Filed: Mar. 25, 2004

(65) Prior Publication Data

US 2004/0189569 A1 Sep. 30, 2004

(30) Foreign Application Priority Data

Mar. 26, 2003 (JP) ..... 2003-086502
Mar. 26, 2003 (JP) ..... 2003-086503
Apr. 28, 2003 (JP) ..... 2003-123491

(51) Int. Cl.
*G09G 3/36* (2006.01)

(52) U.S. Cl. ..... 345/63; 345/89
(58) Field of Classification Search ..... 345/89, 345/60–63
See application file for complete search history.

(56) References Cited

U.S. PATENT DOCUMENTS 5,602,559 A * 2/1997 Kimura ..... 345/89
6,097,358 A * 8/2000 Hirakawa et al. ..... 345/63
6,144,364 A * 11/2000 Otobe et al. ..... 345/691
6,151,011 A * 11/2000 Worley et al. ..... 345/692
6,249,265 B1 * 6/2001 Tajima et al. ..... 345/63
6,323,880 B1 * 11/2001 Yamada ..... 345/690

(Continued)

FOREIGN PATENT DOCUMENTS

JP 09-034399 2/1997 ..... 3/28

(Continued)

OTHER PUBLICATIONS

"DLP Projection System," Display and Imaging, 2001, vol. 9, pp. 76 to 86 (in Japanese with Partial English Translation).

(Continued)

*Primary Examiner*—Amare Mengistu
*Assistant Examiner*—Grant D. Sitta
(74) *Attorney, Agent, or Firm*—Renner, Kenner, Greive, Bobak, Taylor & Weber

(57) ABSTRACT

A display apparatus has a display unit having a matrix of multiple pixels, a divider to divide a field of a digital input video signal to be supplied to the display unit into a specific number of subfields, a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on, and a driver to drive the pixels of the display unit per specific number of subfields so that an image based on the digital input video signal is displayed on the display unit. The subfields are aligned in the look-up table in order of displaying the image. Display periods of the subfields become longer or shorter in order of displaying the image. The difference in display period between subfields becomes smaller per one subfield or per several number of the subfields as the display periods become longer. The difference in display period between subfields may be constant over the subfields.

7 Claims, 13 Drawing Sheets

| DIFFERENCE IN DISPLAY PERIOD (μsec) | 30 | 30 | 20 | 20 | 20 | 20 | 20 | 15 | 15 | 15 | 15 | 10 | 10 | 10 | 10 | 5 | 5 | 5 |
|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| DISPLAY PERIOD (μsec) | 30 | 60 | 90 | 110 | 130 | 150 | 170 | 190 | 205 | 220 | 235 | 250 | 260 | 270 | 280 | 290 | 295 | 300 | 305 |
| GRADATION LEVEL | | | | | | | | | | | | | | | | | | | |
| 0 | | | | | | | | | | | | | | | | | | | |
| 1 | | | | | | | | | 1 | | | | | | | | | | |
| 2 | | | | | | | | | | | | | | | | | | | 1 |
| 3 | | | | 1 | | | | | | | | | | | | | | | 1 |
| 4 | | | | | | | | | 1 | | | | | | | | | | 1 |
| 5 | | | | | | | | | | | | | | 1 | | | | | 1 |
| 6 | | | | | | | | | | | | | | | | | | 1 | 1 |
| | | | | | | | | | | | | | | | | | | | |
| 10 | | | | | | | | 1 | | | | | | | | | | 1 | 1 |
| | | | | | | | | | | | | | | | | | | | |
| | | | | | | | | | | | | | | | | | | | |
| 20 | | | | | | | | | | | | | | | | | 1 | 1 | 1 |
| 21 | 1 | | | | | | | | | | | | | | | | 1 | 1 | 1 |
| 22 | | 1 | | | | | | | | | | | | | | | 1 | 1 | 1 |
| 23 | | | 1 | | | | | | | | | | | | | | 1 | 1 | 1 |
| 24 | | | | 1 | | | | | | | | | | | | | 1 | 1 | 1 |
| 25 | | | | | 1 | | | | | | | | | | | | 1 | 1 | 1 |
| 26 | | | | | | 1 | | | | | | | | | | | 1 | 1 | 1 |
| 27 | | | | | | | 1 | | | | | | | | | | 1 | 1 | 1 |
| 28 | | | | | | | | 1 | | | | | | | | | 1 | 1 | 1 |
| 29 | | | | | | | | | 1 | | | | | | | | 1 | 1 | 1 |
| 30 | | | | | | | | | | 1 | | | | | | | 1 | 1 | 1 |
| 31 | | | | | | | | | | | 1 | | | | | | 1 | 1 | 1 |
| 32 | | | | | | | | | | | | 1 | | | | | 1 | 1 | 1 |
| 33 | | | | | | | | | | | | | 1 | | | | 1 | 1 | 1 |
| 34 | | | | | | | | | | | | | | 1 | | | 1 | 1 | 1 |
| 35 | | | | | | | | | | | | | | | 1 | | 1 | 1 | 1 |
| 36 | | | | | | | | | | | | | | | | 1 | 1 | 1 | 1 |
| 37 | 1 | | | | | | | | | | | | | | | 1 | 1 | 1 | 1 |
| | | | | | | | | | | | | | | | | | | | |
| 100 | | | | | | | | | | | | | 1 | 1 | 1 | 1 | 1 | 1 | 1 |
| | | | | | | | | | | | | | | | | | | | |
| 200 | | | | | | 1 | 1 | 1 | 1 | 1 | 1 | 1 | 1 | 1 | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

U.S. PATENT DOCUMENTS

| | | | | |
|---|---|---|---|---|
| 6,714,250 | B1 * | 3/2004 | Correa et al. | 348/447 |
| 6,831,618 | B1 * | 12/2004 | Suzuki et al. | 345/60 |
| 6,894,664 | B2 * | 5/2005 | Thebault et al. | 345/60 |
| 7,057,584 | B2 * | 6/2006 | Jeong | 345/60 |
| 7,098,873 | B2 * | 8/2006 | Homma | 345/60 |
| 7,113,153 | B2 * | 9/2006 | Kubota et al. | 345/60 |
| 7,126,617 | B2 * | 10/2006 | Yamamoto et al. | 345/690 |
| 2004/0196233 | A1 * | 10/2004 | Shimizu | 345/89 |

FOREIGN PATENT DOCUMENTS

| | | | |
|---|---|---|---|
| JP | 09-172588 | 6/1997 | 5/66 |
| JP | 10-153980 | 6/1998 | 3/28 |
| JP | 10-319903 | 12/1998 | 3/28 |
| JP | 11-015435 | 1/1999 | 3/28 |
| JP | 2001-343950 | 12/2001 | |
| JP | 2002-162944 | 6/2002 | 3/36 |
| JP | 2002-351431 | 12/2002 | 3/36 |

OTHER PUBLICATIONS

"Plasma Display," Nikkei Electronics Oct. 1999, pp. 153 to 162 (in Japanese with Partial English Translation).

* cited by examiner

| DIFFERENCE IN DISPLAY PERIOD (μsec) | 30 | 30 | 20 | 20 | 20 | 20 | 20 | 15 | 15 | 15 | 15 | 10 | 10 | 10 | 10 | 5 | 5 | 5 |
|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| DISPLAY PERIOD (μsec) | 30 | 60 | 90 | 110 | 130 | 150 | 170 | 190 | 205 | 220 | 235 | 250 | 260 | 270 | 280 | 290 | 295 | 300 | 305 |
| GRADATION LEVEL | | | | | | | | | | | | | | | | | | | |
| 0 | | | | | | | | | | | | | | | | | | | |
| 1 | | | | | | | | | 1 | | | | | | | | | | |
| 2 | | | | | | | | | | | | | | | | | | | 1 |
| 3 | | | | 1 | | | | | | | | | | | | | | | 1 |
| 4 | | | | | | | | | 1 | | | | | | | | | | 1 |
| 5 | | | | | | | | | | | | | | 1 | | | | | 1 |
| 6 | | | | | | | | | | | | | | | | | | 1 | 1 |
| | | | | | | | | | | | | | | | | | | | |
| 10 | | | | | | | | 1 | | | | | | | | | | 1 | 1 |
| | | | | | | | | | | | | | | | | | | | |
| | | | | | | | | | | | | | | | | | | | |
| 20 | | | | | | | | | | | | | | | | | 1 | 1 | 1 |
| 21 | 1 | | | | | | | | | | | | | | | | 1 | 1 | 1 |
| 22 | | 1 | | | | | | | | | | | | | | | 1 | 1 | 1 |
| 23 | | | 1 | | | | | | | | | | | | | | 1 | 1 | 1 |
| 24 | | | | 1 | | | | | | | | | | | | | 1 | 1 | 1 |
| 25 | | | | | 1 | | | | | | | | | | | | 1 | 1 | 1 |
| 26 | | | | | | 1 | | | | | | | | | | | 1 | 1 | 1 |
| 27 | | | | | | | 1 | | | | | | | | | | 1 | 1 | 1 |
| 28 | | | | | | | | 1 | | | | | | | | | 1 | 1 | 1 |
| 29 | | | | | | | | | 1 | | | | | | | | 1 | 1 | 1 |
| 30 | | | | | | | | | | 1 | | | | | | | 1 | 1 | 1 |
| 31 | | | | | | | | | | | 1 | | | | | | 1 | 1 | 1 |
| 32 | | | | | | | | | | | | 1 | | | | | 1 | 1 | 1 |
| 33 | | | | | | | | | | | | | 1 | | | | 1 | 1 | 1 |
| 34 | | | | | | | | | | | | | | 1 | | | 1 | 1 | 1 |
| 35 | | | | | | | | | | | | | | | 1 | | 1 | 1 | 1 |
| 36 | | | | | | | | | | | | | | | | 1 | 1 | 1 | 1 |
| 37 | 1 | | | | | | | | | | | | | | | 1 | 1 | 1 | 1 |
| | | | | | | | | | | | | | | | | | | | |
| 100 | | | | | | | | | | | | | 1 | 1 | 1 | 1 | 1 | 1 | 1 |
| | | | | | | | | | | | | | | | | | | | |
| 200 | | | | | | 1 | 1 | 1 | 1 | 1 | 1 | 1 | 1 | 1 | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 3

| DIFFERENCE IN DISPLAY PERIOD (μsec) | 30 | 30 | 20 | 20 | 20 | 20 | 20 | 15 | 15 | 15 | 15 | 10 | 10 | 10 | 10 | 5 | 5 | 5 |
|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| DISPLAY PERIOD (μsec) | 30 | 60 | 90 | 110 | 130 | 150 | 170 | 190 | 205 | 220 | 235 | 250 | 260 | 270 | 280 | 290 | 295 | 300 | 305 |
| GRADATION LEVEL | | | | | | | | | | | | | | | | | | | |
| 0 | | | | | | | | | | | | | | | | | | | |
| 1 | 1 | | | | | | | | | | | | | | | | | | |
| 2 | | 1 | | | | | | | | | | | | | | | | | |
| 3 | | | 1 | | | | | | | | | | | | | | | | |
| 4 | | | | 1 | | | | | | | | | | | | | | | |
| 5 | | | | | 1 | | | | | | | | | | | | | | |
| 6 | | | | | | 1 | | | | | | | | | | | | | |
| 7 | | | | | | | 1 | | | | | | | | | | | | |
| 8 | | | | | | | | 1 | | | | | | | | | | | |
| 9 | | | | | | | | | 1 | | | | | | | | | | |
| 10 | | | | | | | | | | 1 | | | | | | | | | |
| 11 | | | | | | | | | | | 1 | | | | | | | | |
| 12 | | | | | | | | | | | | 1 | | | | | | | |
| 13 | | | | | | | | | | | | | 1 | | | | | | |
| 14 | | | | | | | | | | | | | | 1 | | | | | |
| 15 | | | | | | | | | | | | | | | 1 | | | | |
| 16 | | | | | | | | | | | | | | | | 1 | | | |
| 17 | | | | | | | | | | | | | | | | | 1 | | |
| 18 | | | | | | | | | | | | | | | | | | 1 | |
| 19 | | | | | | | | | | | | | | | | | | | 1 |
| 20 | 1 | | | | | | | | | | | | | | | | | | 1 |
| 21 | | 1 | | | | | | | | | | | | | | | | | 1 |
| 22 | | | 1 | | | | | | | | | | | | | | | | 1 |
| 23 | | | | 1 | | | | | | | | | | | | | | | 1 |
| 24 | | | | | 1 | | | | | | | | | | | | | | 1 |
| 25 | | | | | | 1 | | | | | | | | | | | | | 1 |
| 26 | | | | | | | 1 | | | | | | | | | | | | 1 |
| 27 | | | | | | | | 1 | | | | | | | | | | | 1 |
| 28 | | | | | | | | | 1 | | | | | | | | | | 1 |
| 29 | | | | | | | | | | 1 | | | | | | | | | 1 |
| 30 | | | | | | | | | | | 1 | | | | | | | | 1 |
| 31 | | | | | | | | | | | | 1 | | | | | | | 1 |
| 32 | | | | | | | | | | | | | 1 | | | | | | 1 |
| 33 | | | | | | | | | | | | | | 1 | | | | | 1 |
| 34 | | | | | | | | | | | | | | | 1 | | | | 1 |
| 35 | 1 | | | | | | | | | | | | | | 1 | | | | 1 |
| 36 | | | | | | | | | | | | | | | | 1 | | | 1 |
| 37 | 1 | | | | | | | | | | | | | | | 1 | | | 1 |
| 38 | | | | | | | | | | | | | | | | | 1 | | 1 |
| 39 | | | | | | | | | | | | | | | | | | 1 | 1 |
| 40 | 1 | | | | | | | | | | | | | | | | | 1 | 1 |
| | | | | | | | | | | | | | | | | | | | |
| 100 | | | | | | | | 1 | | | | | | | 1 | 1 | 1 | 1 | 1 |
| | | | | | | | | | | | | | | | | | | | |
| 200 | 1 | | | | | | 1 | 1 | 1 | 1 | 1 | 1 | 1 | 1 | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 5

| DIFFERENCE IN DISPLAY PERIOD (μsec) | 20 | 20 | 20 | 20 | 20 | 20 | 20 | 20 | 20 | 20 | 20 | 20 | 20 | 10 | 20 | 20 | 20 | 20 |
|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| DISPLAY PERIOD (μsec) | 20 | 40 | 60 | 80 | 100 | 120 | 140 | 160 | 180 | 200 | 220 | 240 | 260 | 280 | 300 | 320 | 340 | 360 | 380 |
| GRADATION LEVEL | | | | | | | | | | | | | | | | | | | |
| 0 | | | | | | | | | | | | | | | | | | | |
| 1 | 1 | | | | | | | | | | | | | | | | | | |
| 2 | | 1 | | | | | | | | | | | | | | | | | |
| 3 | | | 1 | | | | | | | | | | | | | | | | |
| 4 | | | | 1 | | | | | | | | | | | | | | | |
| 5 | | | | | 1 | | | | | | | | | | | | | | |
| 6 | | | | | | 1 | | | | | | | | | | | | | |
| 7 | | | | | | | 1 | | | | | | | | | | | | |
| 8 | | | | | | | | 1 | | | | | | | | | | | |
| 9 | | | | | | | | | 1 | | | | | | | | | | |
| 10 | | | | | | | | | | 1 | | | | | | | | | |
| 11 | | | | | | | | | | | 1 | | | | | | | | |
| 12 | | | | | | | | | | | | 1 | | | | | | | |
| 13 | | | | | | | | | | | | | 1 | | | | | | |
| 14 | | | | | | | | | | | | | | 1 | | | | | |
| 15 | | | | | | | | | | | | | | | 1 | | | | |
| 16 | | | | | | | | | | | | | | | | 1 | | | |
| 17 | | | | | | | | | | | | | | | | | 1 | | |
| 18 | | | | | | | | | | | | | | | | | | 1 | |
| 19 | | | | | | | | | | | | | | | | | | | 1 |
| 20 | 1 | | | | | | | | | | | | | | | | | | 1 |
| 21 | | 1 | | | | | | | | | | | | | | | | | 1 |
| 22 | | | 1 | | | | | | | | | | | | | | | | 1 |
| 23 | | | | 1 | | | | | | | | | | | | | | | 1 |
| 24 | | | | | 1 | | | | | | | | | | | | | | 1 |
| 25 | | | | | | 1 | | | | | | | | | | | | | 1 |
| 26 | | | | | | | 1 | | | | | | | | | | | | 1 |
| 27 | | | | | | | | 1 | | | | | | | | | | | 1 |
| 28 | | | | | | | | | 1 | | | | | | | | | | 1 |
| 29 | | | | | | | | | | 1 | | | | | | | | | 1 |
| 30 | | | | | | | | | | | 1 | | | | | | | | 1 |
| 31 | | | | | | | | | | | | 1 | | | | | | | 1 |
| 32 | | | | | | | | | | | | | 1 | | | | | | 1 |
| 33 | | | | | | | | | | | | | | 1 | | | | | 1 |
| 34 | | | | | | | | | | | | | | | 1 | | | | 1 |
| 35 | | | | | | | | | | | | | | | | 1 | | | 1 |
| 36 | | | | | | | | | | | | | | | | | 1 | | 1 |
| 37 | | | | | | | | | | | | | | | | | | 1 | 1 |
| 38 | 1 | | | | | | | | | | | | | | | | | 1 | 1 |
| 39 | | 1 | | | | | | | | | | | | | | | | 1 | 1 |
| 40 | | | 1 | | | | | | | | | | | | | | | 1 | 1 |
| | | | | | | | | | | | | | | | | | | | |
| 100 | | | | | | | | 1 | | | | | | | 1 | 1 | 1 | 1 | 1 |
| | | | | | | | | | | | | | | | | | | | |
| 200 | 1 | | | | | | 1 | 1 | 1 | 1 | 1 | 1 | 1 | 1 | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 8

| | 1ST GROUP | | | | | | | | | | 2ND GROUP | | | | | | | | |
|---|---|---|---|---|---|---|---|---|---|---|---|---|---|---|---|---|---|---|---|
| DIFFERENCE IN DISPLAY PERIOD (μsec) | 30 | 30 | 30 | 20 | 20 | 20 | 20 | 20 | 20 | 20 | 0 | 0 | 0 | 0 | 0 | 0 | 0 | 0 | |
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| DISPLAY PERIOD (μsec) | 30 | 60 | 90 | 120 | 140 | 160 | 180 | 200 | 220 | 240 | 260 | 260 | 260 | 260 | 260 | 260 | 260 | 260 | 260 |
| GRADATION LEVEL | | | | | | | | | | | | | | | | | | | |
| 0 | | | | | | | | | | | | | | | | | | | |
| 1 | 1 | | | | | | | | | | | | | | | | | | |
| 2 | | 1 | | | | | | | | | | | | | | | | | |
| 3 | | | 1 | | | | | | | | | | | | | | | | |
| 4 | | | | 1 | | | | | | | | | | | | | | | |
| 5 | | | | | 1 | | | | | | | | | | | | | | |
| 6 | | | | | | 1 | | | | | | | | | | | | | |
| 7 | | | | | | | 1 | | | | | | | | | | | | |
| 8 | | | | | | | | 1 | | | | | | | | | | | |
| 9 | | | | | | | | | 1 | | | | | | | | | | |
| 10 | | | | | | | | | | 1 | | | | | | | | | |
| 11 | | | | | | | | | | | 1 | | | | | | | | |
| 12 | 1 | | | | | | | | | | | 1 | | | | | | | |
| 13 | | 1 | | | | | | | | | | | 1 | | | | | | |
| 14 | | | 1 | | | | | | | | | | | 1 | | | | | |
| 15 | | | | 1 | | | | | | | | | | | 1 | | | | |
| 16 | | | | | 1 | | | | | | | | | | | 1 | | | |
| 17 | | | | | | 1 | | | | | | | | | | | 1 | | |
| 18 | | | | | | | 1 | | | | | | | | | | | 1 | |
| 19 | | | | | | | | 1 | | | | | | | | | | | 1 |
| 20 | | | | | | | | | 1 | | | | | | | | | | 1 |
| 21 | | | | | | | | | | 1 | | | | | | | | | 1 |
| 22 | | | | | | | | | | | 1 | | | | | | | | 1 |
| 23 | 1 | | | | | | | | | | | 1 | | | | | | | 1 |
| 24 | | 1 | | | | | | | | | | | 1 | | | | | | 1 |
| 25 | | | 1 | | | | | | | | | | | 1 | | | | | 1 |
| 26 | | | | 1 | | | | | | | | | | | 1 | | | | 1 |
| 27 | | | | | 1 | | | | | | | | | | | 1 | | | 1 |
| 28 | | | | | | 1 | | | | | | | | | | | 1 | | 1 |
| 29 | | | | | | | 1 | | | | | | | | | | | 1 | 1 |
| 30 | 1 | | | | | | 1 | | | | | | | | | | | 1 | 1 |
| 31 | | | | | | | | 1 | | | | | | | | | | 1 | 1 |
| 32 | 1 | | | | | | | 1 | | | | | | | | | | 1 | 1 |
| 33 | | | | | | | | | 1 | | | | | | | | | 1 | 1 |
| 34 | | | | | | | | | 1 | | | | | | | | | 1 | 1 |
| 35 | | | | | | | | | | 1 | | | | | | | | 1 | 1 |
| 36 | | | | | | | | | | 1 | | | | | | | | 1 | 1 |
| 37 | | | | | | | | | | | 1 | | | | | | | 1 | 1 |
| 38 | 1 | | | | | | | | | | | 1 | | | | | | 1 | 1 |
| 39 | | 1 | | | | | | | | | | | 1 | | | | | 1 | 1 |
| 40 | | | 1 | | | | | | | | | | | 1 | | | | 1 | 1 |
| | | | | | | | | | | | | | | | | | | 1 | 1 |
| 100 | | | | | | | | | | | 1 | 1 | 1 | 1 | 1 | 1 | 1 | 1 | 1 |
| | | | | | | | | | | | | | | | | | | 1 | 1 |
| 200 | 1 | | | | | | 1 | 1 | 1 | 1 | 1 | 1 | 1 | 1 | 1 | 1 | 1 | 1 | 1 |
| | | | | | | | | | | | | | | | | | | 1 | 1 |
| 255 | 1 | 1 | 1 | 1 | 1 | 1 | 1 | 1 | 1 | 1 | 1 | 1 | 1 | 1 | 1 | 1 | 1 | 1 | 1 |

FIG. 9

| | 2ND GROUP | | | | | | 1ST GROUP | | | | | | | 3RD GROUP | | | | | |
|---|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| PISPLAY PERIOD (μsec) | 305 | 300 | 295 | 290 | 280 | 270 | 220 | 60 | 150 | 30 | 180 | 90 | 220 | 270 | 280 | 290 | 295 | 300 | 305 |
| GRADATION LEVEL | | | | | | | | | | | | | | | | | | | |
| 0 | | | | | | | | | | 1 | | | | | | | | | |
| 1 | | | | | | | | 1 | | | | | | | | | | | |
| 2 | | | | | | | | | | | | 1 | | | | | | | |
| 3 | | | | | | | | | | 1 | | 1 | | | | | | | |
| 4 | | | | | | | | | 1 | | | | | | | | | | |
| 5 | | | | | | | | | 1 | 1 | | | | | | | | | |
| 6 | | | | | | | | | | | 1 | | | | | | | | |
| 7 | | | | | | | | | | 1 | 1 | | | | | | | | |
| 8 | | | | | | | | | | | | | 1 | | | | | | |
| 9 | | | | | | | | | | 1 | | | 1 | | | | | | |
| 10 | | | | | | | | 1 | | | | | 1 | | | | | | |
| 11 | | | | | | | | | | | | | | 1 | | | | | |
| 12 | | | | | | | | | | | | | | | 1 | | | | |
| 13 | | | | | | | | | | | | | | | | 1 | | | |
| 14 | | | | | | | | | | | | | | | | | 1 | | |
| 15 | | | | | | | | | | | | | | | | | | 1 | |
| 16 | | | | | | | | | | 1 | | | | | | | | 1 | |
| 17 | | | | | | | | | | | | | | | | | | | 1 |
| 18 | | | | | | | | | | 1 | | | | | | | | | 1 |
| 19 | | | | | | | | 1 | | | | | | | | | | | 1 |
| 20 | | | | | | | | | | | | 1 | | | | | | | 1 |
| 21 | | | | | | | | | | 1 | | 1 | | | | | | | 1 |
| 22 | | | | | | | | | 1 | | | | | | | | | | 1 |
| 23 | | | | | | | | | 1 | 1 | | | | | | | | | 1 |
| 24 | | | | | | | | 1 | 1 | | | | | | | | | | 1 |
| 25 | | | | | | | | 1 | 1 | 1 | | | | | | | | | 1 |
| 26 | | | | | | | | 1 | | | | | | | | | | | 1 |
| 27 | | | | | | | 1 | | | 1 | | | | | | | | | 1 |
| 28 | | | | | | | 1 | | | | | | | | | | | | 1 |
| 29 | | | | | | | 1 | 1 | | | | | | | | | | | 1 |
| 30 | | | | | | 1 | | | | | | | | | | | | | 1 |
| 31 | | | | | 1 | | | | | | | | | | | | | | 1 |
| 32 | | | | 1 | | | | | | | | | | | | | | | 1 |
| 33 | | | 1 | | | | | | | | | | | | | | | | 1 |
| 34 | | 1 | | | | | | | | | | | | | | | | | 1 |
| 35 | 1 | | | | | | | | | | | | | | | | | | 1 |
| 36 | 1 | | | | | | | | | 1 | | | | | | | | | 1 |
| 37 | 1 | | | | | | | 1 | | | | | | | | | | | 1 |
| 38 | 1 | | | | | | | | | | | 1 | | | | | | | 1 |
| 39 | 1 | | | | | | | | | 1 | | 1 | | | | | | | 1 |
| 40 | 1 | | | | | | | | 1 | | | | | | | | | | 1 |
| | | | | | | | | | | | | | | | | | | | |
| 100 | 1 | 1 | | | | | | | | | | 1 | | | | | 1 | 1 | 1 |
| | | | | | | | | | | | | | | | | | | | |
| 200 | 1 | 1 | 1 | 1 | 1 | | | | | 1 | | | | | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 10

| | 2ND GROUP | | | | | | 1ST GROUP | | | | | | | 3RD GROUP | | | | | |
|---|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| DISPLAY PERIOD (μsec) | 290 | 290 | 290 | 290 | 290 | 290 | 220 | 60 | 150 | 30 | 180 | 90 | 220 | 290 | 290 | 290 | 290 | 290 | 290 |
| GRADATION LEVEL | | | | | | | | | | | | | | | | | | | |
| 0 | | | | | | | | | | 1 | | | | | | | | | |
| 1 | | | | | | | | 1 | | | | | | | | | | | |
| 2 | | | | | | | | | | | | 1 | | | | | | | |
| 3 | | | | | | | | | | 1 | | 1 | | | | | | | |
| 4 | | | | | | | | | 1 | | | | | | | | | | |
| 5 | | | | | | | | | 1 | 1 | | | | | | | | | |
| 6 | | | | | | | | | | | 1 | | | | | | | | |
| 7 | | | | | | | | | | 1 | 1 | | | | | | | | |
| 8 | | | | | | | | | | | | | 1 | | | | | | |
| 9 | | | | | | | | | | 1 | | | 1 | | | | | | |
| 10 | | | | | | | | 1 | | | | | 1 | | | | | | |
| 11 | | | | | | | | | | | | 1 | 1 | | | | | | |
| 12 | | | | | | | | | | | | | | 1 | | | | | |
| 13 | | | | | | | | | | 1 | | | | | 1 | | | | |
| 14 | | | | | | | | 1 | | | | | | | | 1 | | | |
| 15 | | | | | | | | | | | | 1 | | | | | 1 | | |
| 16 | | | | | | | | | | 1 | | 1 | | | | | | 1 | |
| 17 | | | | | | | | | 1 | | | | | | | | | | 1 |
| 18 | | | | | | | | | 1 | 1 | | | | | | | | | 1 |
| 19 | | | | | | | | 1 | 1 | | | | | | | | | | 1 |
| 20 | | | | | | | | 1 | 1 | 1 | | | | | | | | | 1 |
| 21 | | | | | | | | 1 | | | | | | | | | | | 1 |
| 22 | | | | | | | 1 | | | 1 | | | | | | | | | 1 |
| 23 | | | | | | | 1 | | | | | | | | | | | | 1 |
| 24 | | | | | | | 1 | 1 | | | | | | | | | | | 1 |
| 25 | | | | | | 1 | | | | | | | | | | | | | 1 |
| 26 | | | | | 1 | | | | | 1 | | | | | | | | | 1 |
| 27 | | | | 1 | | | | 1 | | | | | | | | | | | 1 |
| 28 | | | 1 | | | | | | | | | 1 | | | | | | | 1 |
| 29 | | 1 | | | | | | | | 1 | | 1 | | | | | | | 1 |
| 30 | 1 | | | | | | | | 1 | | | | | | | | | | 1 |
| 31 | 1 | | | | | | | | 1 | 1 | | | | | | | | | 1 |
| 32 | 1 | | | | | | | | | | 1 | | | | | | | | 1 |
| 33 | 1 | | | | | | | | | 1 | 1 | | | | | | | | 1 |
| 34 | 1 | | | | | | | | | | | | 1 | | | | | | 1 |
| 35 | 1 | | | | | | | | | 1 | | | 1 | | | | | | 1 |
| 36 | 1 | | | | | | | | | | | | | 1 | | | | | 1 |
| 37 | 1 | | | | | | | | | 1 | | | | | 1 | | | | 1 |
| 38 | 1 | | | | | | | 1 | | | | | | | | 1 | | | 1 |
| 39 | 1 | | | | | | | | | | | 1 | | | | | 1 | | 1 |
| 40 | 1 | | | | | | | | | 1 | | 1 | | | | | | 1 | 1 |
| | | | | | | | | | | | | | | | | | | | |
| 100 | 1 | 1 | 1 | | | | | | | | | | | | | 1 | 1 | 1 | 1 |
| | | | | | | | | | | | | | | | | | | | |
| 200 | 1 | 1 | 1 | 1 | 1 | 1 | | | | | | | | 1 | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 11

| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
|---|---|---|---|---|---|---|---|---|---|---|---|---|---|---|---|---|---|---|---|
| PROVISIONAL SUBFIELD | SF1 | SF2 | SF8 | SF3 | SF4 | SF12 | SF5 | SF11 | SF6 | SF7 | SF13 | SF14 | SF15 | SF9 | SF16 | SF17 | SF10 | SF18 | SF19 |
| DISPLAY PERIOD (μsec) | 305 | 300 | 60 | 295 | 290 | 90 | 280 | 180 | 270 | 220 | 220 | 270 | 280 | 150 | 290 | 295 | 30 | 300 | 305 |
| GRADATION LEVEL | | | | | | | | | | | | | | | | | | | |
| 0 | | | | | | | | | | | | | | | | | 1 | | |
| 1 | | | 1 | | | | | | | | | | | | | | | | |
| 2 | | | | | | 1 | | | | | | | | | | | | | |
| 3 | | | | | | 1 | | | | | | | | | | | 1 | | |
| 4 | | | | | | | | | | | | | | 1 | | | | | |
| 5 | | | | | | | | | | | | | | 1 | | | 1 | | |
| 6 | | | | | | | | 1 | | | | | | | | | | | |
| 7 | | | | | | | | 1 | | | | | | | | | 1 | | |
| 8 | | | | | | | | | | | 1 | | | | | | | | |
| 9 | | | | | | | | | | | 1 | | | | | | 1 | | |
| 10 | | | 1 | | | | | | | | 1 | | | | | | | | |
| 11 | | | | | | | | | | | | 1 | | | | | | | |
| 12 | | | | | | | | | | | | | 1 | | | | | | |
| 13 | | | | | | | | | | | | | | | 1 | | | | |
| 14 | | | | | | | | | | | | | | | | 1 | | | |
| 15 | | | | | | | | | | | | | | | | | | 1 | |
| 16 | | | | | | | | | | | | | | | | | 1 | 1 | |
| 17 | | | | | | | | | | | | | | | | | | | 1 |
| 18 | | | | | | | | | | | | | | | | | 1 | | 1 |
| 19 | | | 1 | | | | | | | | | | | | | | | | 1 |
| 20 | | | | | | 1 | | | | | | | | | | | | | 1 |
| 21 | | | | | | 1 | | | | | | | | | | | 1 | | 1 |
| 22 | | | | | | | | | | | | | | 1 | | | | | 1 |
| 23 | | | | | | | | | | | | | | 1 | | | 1 | | 1 |
| 24 | | | 1 | | | | | | | | | | | 1 | | | | | 1 |
| 25 | | | 1 | | | | | | | | | | | 1 | | | 1 | | 1 |
| 26 | | | 1 | | | | | | | | | | | | | | | | 1 |
| 27 | | | | | | | | | | 1 | | | | | | | 1 | | 1 |
| 28 | | | | | | | | | | 1 | | | | | | | | | 1 |
| 29 | | | 1 | | | | | | | 1 | | | | | | | | | 1 |
| 30 | | | | | | | | | 1 | | | | | | | | | | 1 |
| 31 | | | | | | | 1 | | | | | | | | | | | | 1 |
| 32 | | | | | 1 | | | | | | | | | | | | | | 1 |
| 33 | | | | 1 | | | | | | | | | | | | | | | 1 |
| 34 | | 1 | | | | | | | | | | | | | | | | | 1 |
| 35 | 1 | | | | | | | | | | | | | | | | | | 1 |
| 36 | 1 | | | | | | | | | | | | | | | | 1 | | 1 |
| 37 | 1 | | 1 | | | | | | | | | | | | | | | | 1 |
| 38 | 1 | | | | | 1 | | | | | | | | | | | | | 1 |
| 39 | 1 | | | | | 1 | | | | | | | | | | | 1 | | 1 |
| 40 | 1 | | | | | | | | | | | | | 1 | | | | | 1 |
| | | | | | | | | | | | | | | | | | | | |
| 100 | 1 | 1 | | | | 1 | | | | | | | | | | 1 | | 1 | 1 |
| | | | | | | | | | | | | | | | | | | | |
| 200 | 1 | 1 | | 1 | 1 | | 1 | | | | | | 1 | | 1 | 1 | 1 | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 13

| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
|---|---|---|---|---|---|---|---|---|---|---|---|---|---|---|---|---|---|---|---|
| PROVISIONAL SUBFIELD | SF1 | SF2 | SF8 | SF3 | SF4 | SF12 | SF5 | SF11 | SF6 | SF7 | SF13 | SF14 | SF15 | SF9 | SF16 | SF17 | SF10 | SF18 | SF19 |
| DISPLAY PERIOD (μsec) | 290 | 290 | 60 | 290 | 290 | 90 | 290 | 180 | 290 | 220 | 220 | 290 | 290 | 150 | 290 | 290 | 30 | 290 | 290 |
| GRADATION LEVEL | | | | | | | | | | | | | | | | | | | |
| 0 | | | | | | | | | | | | | | | | | 1 | | |
| 1 | | | 1 | | | | | | | | | | | | | | | | |
| 2 | | | | | | 1 | | | | | | | | | | | | | |
| 3 | | | | | | 1 | | | | | | | | | | | 1 | | |
| 4 | | | | | | | | | | | | | | 1 | | | | | |
| 5 | | | | | | | | | | | | | | 1 | | | 1 | | |
| 6 | | | | | | | | 1 | | | | | | | | | | | |
| 7 | | | | | | | | 1 | | | | | | | | | 1 | | |
| 8 | | | | | | | | | | | 1 | | | | | | | | |
| 9 | | | | | | | | | | | 1 | | | | | | 1 | | |
| 10 | | | 1 | | | | | | | | 1 | | | | | | | | |
| 11 | | | | | | 1 | | | | | 1 | | | | | | | | |
| 12 | | | | | | | | | | | | 1 | | | | | | | |
| 13 | | | | | | | | | | | | | 1 | | | | 1 | | |
| 14 | | | 1 | | | | | | | | | | | | 1 | | | | |
| 15 | | | | | | 1 | | | | | | | | | | 1 | | | |
| 16 | | | | | | 1 | | | | | | | | | | | 1 | 1 | |
| 17 | | | | | | | | | | | | | | 1 | | | | | 1 |
| 18 | | | | | | | | | | | | | | 1 | | | 1 | | 1 |
| 19 | | | 1 | | | | | | | | | | | 1 | | | | | 1 |
| 20 | | | 1 | | | | | | | | | | | 1 | | | 1 | | 1 |
| 21 | | | 1 | | | | | | | | | | | | | | | | 1 |
| 22 | | | | | | | | | | 1 | | | | | | | 1 | | 1 |
| 23 | | | | | | | | | | 1 | | | | | | | | | 1 |
| 24 | | | 1 | | | | | | | 1 | | | | | | | | | 1 |
| 25 | | | | | | | | | 1 | | | | | | | | | | 1 |
| 26 | | | | | | | 1 | | | | | | | | | | 1 | | 1 |
| 27 | | | 1 | | 1 | | | | | | | | | | | | | | 1 |
| 28 | | | | 1 | | 1 | | | | | | | | | | | | | 1 |
| 29 | | 1 | | | | 1 | | | | | | | | | | | 1 | | 1 |
| 30 | 1 | | | | | | | | | | | | | 1 | | | | | 1 |
| 31 | 1 | | | | | | | | | | | | | 1 | | | 1 | | 1 |
| 32 | 1 | | | | | | | 1 | | | | | | | | | | | 1 |
| 33 | 1 | | | | | | | 1 | | | | | | | | | 1 | | 1 |
| 34 | 1 | | | | | | | | | | 1 | | | | | | | | 1 |
| 35 | 1 | | | | | | | | | | 1 | | | | | | 1 | | 1 |
| 36 | 1 | | | | | | | | | | | 1 | | | | | | | 1 |
| 37 | 1 | | | | | | | | | | | | 1 | | | | 1 | | 1 |
| 38 | 1 | | 1 | | | | | | | | | | | | 1 | | | | 1 |
| 39 | 1 | | | | | 1 | | | | | | | | | | 1 | | | 1 |
| 40 | 1 | | | | | 1 | | | | | | | | | | | 1 | 1 | 1 |
| | | | | | | | | | | | | | | | | | | | |
| 100 | 1 | 1 | | 1 | | | | | | | | | | | 1 | 1 | | 1 | 1 |
| | | | | | | | | | | | | | | | | | | | |
| 200 | 1 | 1 | | 1 | 1 | | 1 | | 1 | | | 1 | 1 | | 1 | 1 | | 1 | 1 |
| | | | | | | | | | | | | | | | | | | | |
| 255 | 1 | 1 | 1 | 1 | 1 | 1 | 1 | 1 | 1 | 1 | 1 | 1 | 1 | 1 | 1 | 1 | 1 | 1 | 1 |

FIG. 14

DISPLAY APPARATUS

BACKGROUND OF THE INVENTION

The present invention relates to a display apparatus, such as a liquid crystal display apparatus (for example, a projection display, a view finder, a head mount display), a plasma display apparatus, a digital mirror display apparatus, an electroluminescent display apparatus, and a field emission display apparatus.

A popular technique of displaying images on these several types of display apparatus is to convert analog video signals into digital video signals and apply the digital video signals to pixels, with division of one TV field into several sequential subfields having different weights.

These types of display apparatus have such a subfield structure, even under different drive sequences, thus causing pseudo contour effects in moving-picture displaying.

One TV field has, for example, several 8-bit subfields with the ratio of duration 1 ($=2^0$): 2 ($=2^1$): 4 ($=2^2$): 8 ($=2^3$): 16 ($=2^4$): 32 ($=2^5$): 64 ($=2^6$): 128 ($=2^7$).

Combination of these subfields achieves 256 gradation levels (0 to 255). Pseudo contour effects in moving pictures could be caused by difference in emission timing at these several subfields. The quality of moving-picture images is lowered due to pseudo contour effects as the pictures move fast because the difference in emission timing appears as spatial difference.

Illustrated in FIG. 1A is occurrence of pseudo contour effects. There are 8 successive subfields SF1 to SF8 at gradation levels 127 and 128 for adjacent two pixels. An image is displayed from the subfields SF1 to SF8. Dot areas indicate off(black)-display whereas no-dot areas on(white)-display. The higher the gradation level, the doser to white whereas the lower the gradation level, the doser to black. Signs S1, S2 and S3 indicate the height or position of viewer's line of vision.

At the position S2, light Y1 passing through the subfields SF1 to SF7 of white (pixel on) and the subfield SF8 of black (pixel off) enters viewer's eyes correctly at the level 127.

When the viewer's line of vision is shifted from the middle position S2 to the upper position S1, light Y2 passing through the subfields SF1 to SF8 of black (almost no light) enters viewer's eyes, thus gradation being lowered from the level 127 to the level 0 (pure black). This shift of line of vision generates pseudo contours of black level which cause pseudo contour effects.

On the contrary, when the viewer's line of vision is shifted from the middle position S2 to the lower position S3, light Y3 passing through the subfields SF1 to SF8 of white enters viewer's eyes, thus gradation being raised from the level 127 to the level 255 (pure white). This shift of line of vision generates pseudo contours white level which also cause pseudo contour effects.

There are several proposals for reducing moving-picture pseudo contour effects, for example, disclosed in non-patent literature (1) "DLP Projection System" display and Imaging 2001, Vol. 9, pp 79 to 86; non-patent literature (2) Nikkei Electronics Apr. 10, 1999 (No. 753); patent literature (1) U. S. Pat. No. 6,151,011; and patent literature (2) Japanese Un-examined Patent Publication No. 2001-343950.

The non-patent literature (1) discloses division of subfields having long display periods into several subfields having short display periods and rearrangements to the subfields of short display periods in one TV field. The subfield division and rearrangements minimizes displacement of light emitted from a display device in the direction of time when a subfield that is on is switched to the next subfield, thus pseudo contour effects being hardly observed.

The patent literature (1) also discloses division of subfields having long display periods into several subfields having short display periods in a liquid crystal display apparatus.

Illustrated in FIG. 1B is reduction of pseudo contour effects in the patent literature (1). There are 19 successive subfields SF1 to SF19 at gradation levels 126 to 130. Dot areas indicate off(black)-display whereas no-dot areas on(white)-display. The number in each no-dot area indicates the level of brightness. For example, the subfields SF8 to SF11 are off whereas the subfield SF12 is on at the gradation level 128.

The shift of viewer's line of vision from the position S2 to S1 or S3 does not cause pseudo contour effects because light Y1 to Y3 enter viewer's eyes at the same gradation level 127.

The non-patent literature (2) discloses CLEAR (Hi-Contrast and Low Energy Address and Reduction of False Contour Sequence) that controls emission period in accordance with brightness in a plasma display apparatus for reduction of false contour sequence or pseudo contour effects. The patent literature (2) also discloses control of emission period in accordance with brightness for reduction of pseudo contour effects.

The known techniques disclosed in the above literatures, however, have the following drawbacks, as illustrated in FIG. 1C.

Suppose that, instead of the subfield SF12 which is on at the gradation level 128 as shown in FIG. 1B, when the subfield SF 17 apart from the subfield SF12 is turned on at the gradation level 128 as shown in FIG. 1C, based on the disclosures in the patent literature (1) and non-patent literature (1).

At the position S2, light Y1 enters viewer's eyes correctly at the gradation level 127. The shift of the viewer's line of vision from the position S2 to S1 (Y1 to Y2) also achieves the gradation level 127. In contrast, the shift from the position S2 to S3 (Y1 to Y3) raises the gradation from the level 127 to the level 143, change in gradation by 16 levels (=143−127), which causes pseudo contour effects at the boundary between the positions S2 and S3.

The non-patent literature (2) employs 24 subfields per 2 fields for the maximum 24 gradation levels, thus requiring signal processing, such as, dither and error diffusion, for full gradation displays.

Moreover, the patent literature (2) requires additional controlling circuitry for converting bit plane into subfield per pixel in accordance with brightness because no look-up table of each subfield to be accessed and the corresponding bit plane to be displayed being provided, thus being complex in circuit configuration.

SUMMARY OF THE INVENTION

A purpose of the present invention is to provide a display apparatus with optimum subfield structure for displaying moving pictures at correct gradations while reducing pseudo contour effects to enhance the quality of moving-picture images.

The present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields are aligned in the look-up table in order of displaying the image, display periods of the subfields become longer or shorter in order of displaying the image, a difference in display period between subfields becomes smaller per one subfield or per several number of the subfields as the display periods become longer.

Moreover, the present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields are aligned in the look-up table in order of displaying the image, display periods of the subfields become longer or shorter in order of displaying the image, a difference in display period between subfields is constant over the subfields.

Furthermore, the present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields is divided into a first subfield group and a second subfield group aligned in the look-up table in order of displaying the image, first subfields in the first subfield group have display periods that become longer or shorter in order of displaying the image whereas second subfields in the second subfield group have a display period constant over the second subfields.

Still furthermore, the present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields is divided into a first subfield group, a second subfield group and a third subfield group aligned in the look-up table in order of displaying the image, first subfields in the first subfield group have display periods that become shorter in order of displaying the image, second subfields in the second subfield group have display periods shorter than the display periods of the first subfields, and third subfields in the third subfield group have display periods that become longer in order of displaying the image.

Moreover, the present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields is divided into a first subfield group, a second subfield group and a third subfield group aligned in the look-up table in order of displaying the image, first subfields in the first subfield group have a display period constant over the first subfields, second subfields in the second subfield group have display periods shorter than the display period of the first subfields, and third subfields in the third subfield group have a display period constant over the third subfields.

Furthermore, the present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields are aligned into a subfield sequence in order of displaying the image in the look-up table, the specific number of subfields are divided into a first subfield group, a second subfield group and a third subfield group, subfields of the first subfield group have first different display periods, subfields of the second subfield group have second display periods all longer than the first display periods, the second display periods becoming shorter in order of displaying the image, the third subfield group have third display periods becoming longer in order of displaying the image, the subfields of the first subfield group being dispersed into the second and third subfield groups, the subfields of the second subfield group and the subfields of the first subfield group dispersed into the second subfield group consisting of a former half of the subfield sequence in order of displaying the image, the subfields of the third subfield group and the subfields of the first subfield group dispersed into the third subfield group consisting of a latter half of the subfield sequence in order of displaying the image, a total of the display periods in the former half of the subfield sequence and a total of the display periods in the latter half of the subfield sequence being almost equal to each other.

Still furthermore, the present invention provides a display apparatus comprising: a display unit having a matrix of multiple pixels; a divider to divide a field of a digital input video signal to be supplied to the display unit into a specific number of subfields; a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turn on; and a driver to drive the pixels of the display unit per specific number of subfields so that an image based on the digital input video signal is displayed on the display unit, wherein the specific number of subfields are aligned into a subfield sequence in order of displaying the image in the look-up table, the specific number of subfields are divided into a first subfield group, a second subfield group and a third subfield group, subfields of the first subfield group have first different display periods, subfields of the second subfield group have a constant second display period longer than the first display periods, subfields of the third subfield group have a constant third display period, the subfields of the first subfield group being dispersed into the second and third subfield groups, the subfields of the second subfield group and the subfields of the first subfield group dispersed. into the second subfield group consisting of a former half of the subfield sequence in order of displaying the image, the subfields of the third subfield group and the subfields of the first subfield group dispersed into the third subfield group consisting of a latter half of the subfield sequence in order of displaying the image, a total of the display periods in the former half of the subfield sequence and a total of the display periods in the latter half of the subfield sequence being almost equal to each other.

BRIEF DESCRIPTION OF DRAWINGS

FIG. 3 shows a look-up table used in field division in the liquid crystal display apparatus shown in FIG. 2;

FIG. 5 shows a first modification to the look-up table shown in FIG. 3;

FIG. 8 shows a second modification to the look-up table shown in FIG. 3;

FIG. 9 shows a third modification to the look-up table shown in FIG. 3;

FIG. 10 shows a fourth modification to the look-up table shown in FIG. 3;

FIG. 11 shows a fifth modification to the look-up table shown in FIG. 3;

FIG. 13 shows a sixth modification to the look-up table shown in FIG. 3;

FIG. 14 shows a seventh modification to the look-up table shown in FIG. 3.

DETAILED DESCRIPTION OF PREFERRED EMBODIMENT

An embodiment of a display apparatus according to the present invention will be disclosed with reference to the attached drawings.

Figure 2:
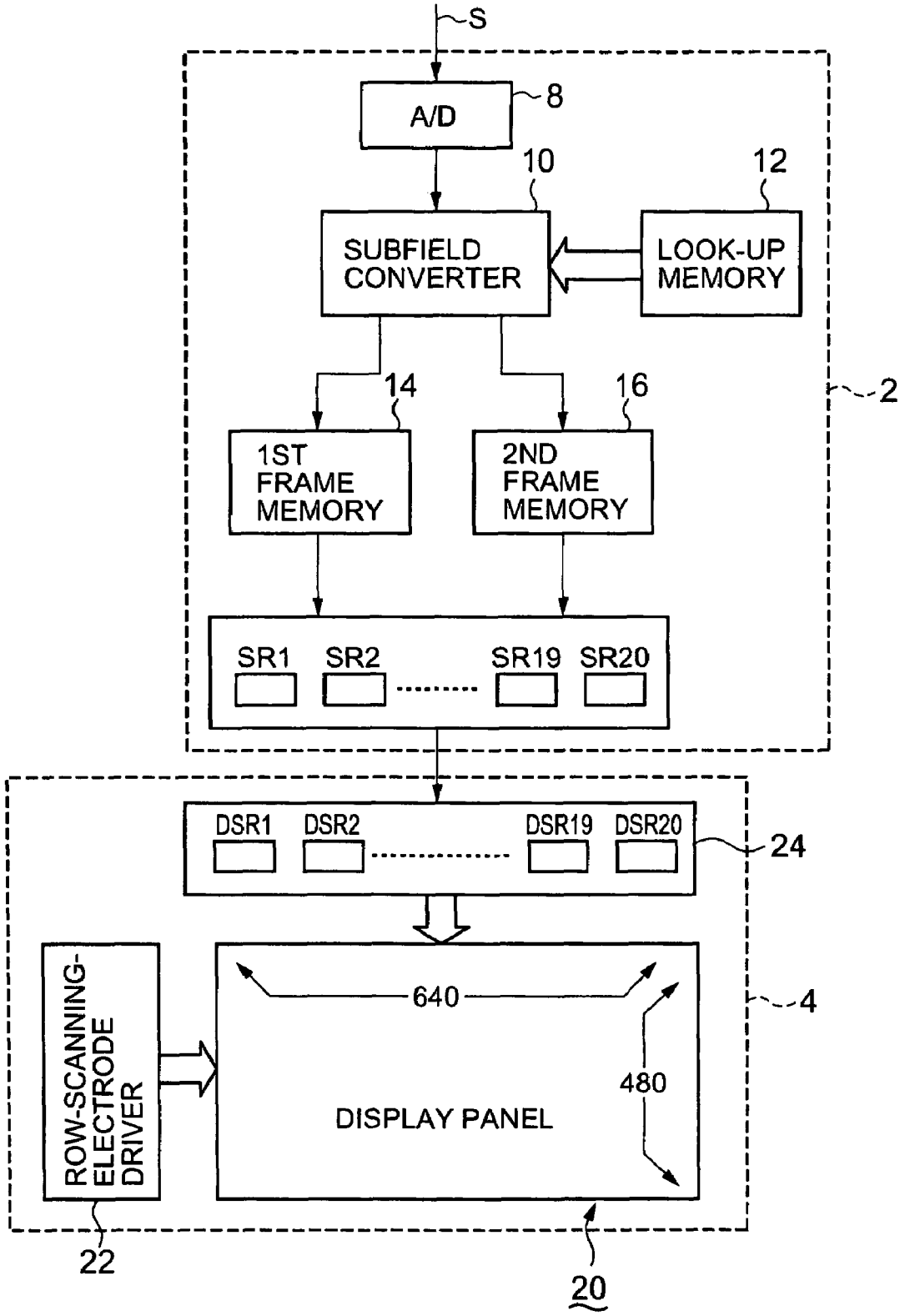
FIG. 2 shows a block diagram of a liquid crystal display apparatus as an embodiment according to the present invention.

FIG. 2 shows a block diagram of a liquid crystal display apparatus as an embodiment according to the present invention. Not only such a liquid crystal display apparatus, the present invention is applicable to other types of display apparatus, for example, a plasma display apparatus, a digital mirror display apparatus, an electroluminescent display apparatus, and a field emission display apparatus.

The display apparatus shown in FIG. 2 is mainly equipped with a subfield controller 2 for converting an input video signal S into a digital signal and diving one field of the digital signal into a plurality of subfields and a liquid-crystal display unit 4 having multiple pixels arranged into a matrix to display images when the digital signal produced at the controller 2 is supplied.

The subfield controller 2 is equipped with an A/D converter 8 for converting an analog input video signal into a digital signal; a subfield converter 10 for dividing one field of the digital video signal into 19 subfields; a look-up memory 12 for storing a look-up table, such as shown in FIG. 3, to be used for field division; a first frame memory 14 and a second frame memory 16 for storing the output signals of the subfield converter 10; and twenty shift registers SR1 to SR20 for storing subfield data output from the frame memories 14 and 16. The number of the divided subfields may be more or less than 19.

The display unit 4 is equipped with a display panel 20 having 640×480 pixels (not shown) arranged into a matrix, a row-scanning-electrode driver 22 and a column-signal-electrode driver 24, both drivers being connected to the display panel 20. The column-signal-electrode driver 24 includes shift registers DSR1 to DSR20 for storing data sent from the shift registers SR1 to SR20.

Disclosed next is the operation of the display apparatus shown in FIG. 2.

Figure 4:
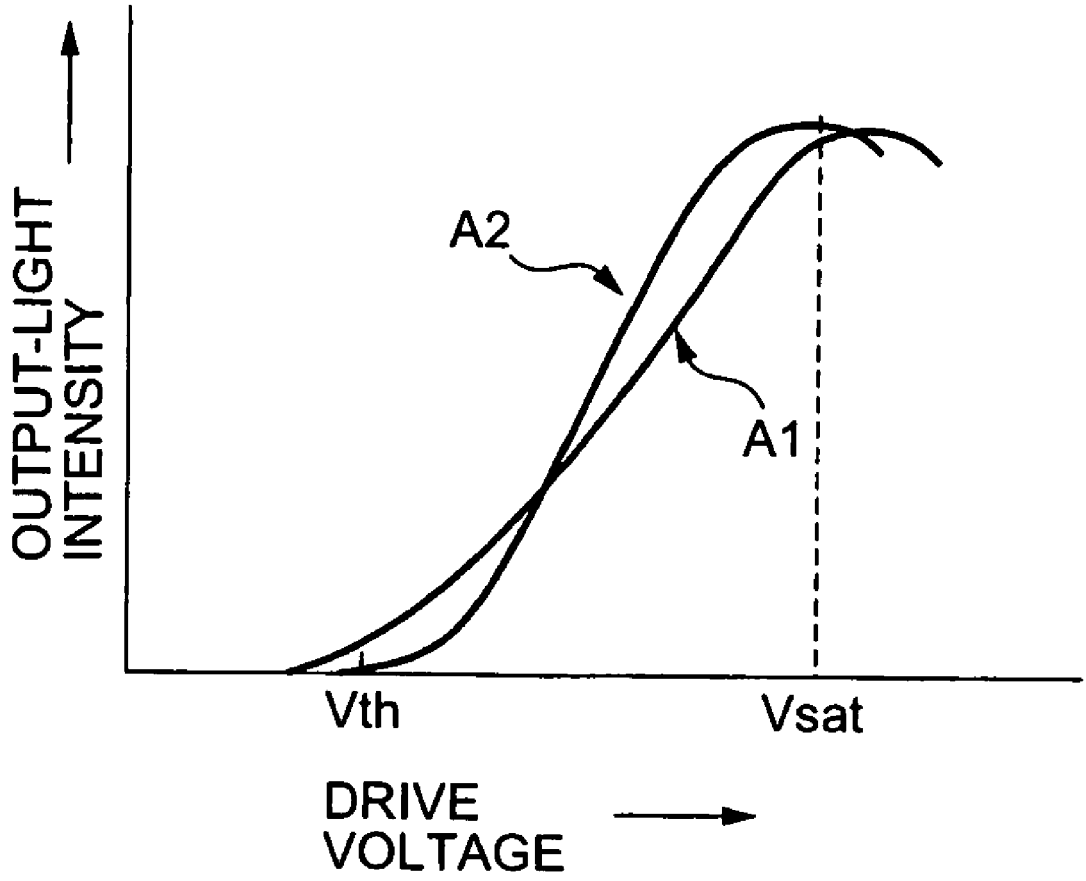
FIG. 4 shows change in output-light intensity against liquid-crystal driving voltage.

An input analog video signal S is converted into, for example, an 8-bit digital signal by the A/D converter 8. The input analog video signal is usually based on CRT reverse-gamma characteristics, thus exhibiting S-shaped output-light intensity v. s. liquid-crystal driving voltage characteristics, such as shown in FIG. 4, hence providing inaccurate gradation. In FIG. 4, the signs "Vth" and "Vsat" indicate a threshold voltage and a saturation voltage, respectively.

The display apparatus according to the present invention employs a look-up table, such as shown in FIG. 3, stored in the look-up table memory 12, listing gradation levels and subfields, for subfield-period adjustments and on-off control for each subfield, to provide accurate gradation (by gamma correction) and reduce pseudo contour effects.

Listed in the look-up table are 256 gradation levels giving "1" for the subfields during which an image is displayed. The signs "1" are given only at several gradation levels in FIG. 3 for brevity. Display is performed sequentially from a subfield SF1 to a subfield SF19. These are the same for several modifications (which will be disclosed later) to the look-up table shown in FIG. 3.

The 19 subfields SF1, SF2, SF3, . . . , and SF19 are aligned such that the subfield period is the shortest for the first subfield SF1 (30 microseconds) and gradually made longer towards the last subfield SF19 having the longest (305 microseconds).

The difference in subfield period between successive subfields is equal to one other per given number of subfields and becomes shorter as the subfield period becomes longer. In detail, the difference in subfield period between successive subfields is 30 microseconds for the shorter subfield periods, which, however, be shorter, such as 20 microseconds, 15 microseconds, 10 microseconds and then 5 microseconds, as the subfield period becomes longer.

In detail, the differences in subfield period between successive subfields are: 30 microseconds from the subfields SF1 to SF3; 20 microseconds from the subfields SF3 to SF8; 15 microseconds from the subfields SF8 to SF12; 10 microseconds from the subfields SF12 to SF16; and 5 microseconds from the subfields SF16 to SF19. In other words, the difference in display period between successive subfields becomes shorter, such as, 30 microseconds→20 microseconds→15 microseconds→10 microseconds→5 microseconds, as the display period becomes longer.

Moreover, in FIG. 3, as shown in the range from gradation level 21 to 36, as the level becomes higher, the subfield which is turned on ("1"), or for which an image is displayed, is shifted from the subfield having the shortest subfield period by 1 subfield towards the subfield having the longest subfield period. And, also, in the range from gradation level 21 to 36, when the subfield having the longest subfield period is turned on at a certain gradation level among those which have been turned off, the subfield having the longest subfield period is continuously turned on at gradation levels higher than the certain gradation level. Although not shown, the drive sequence is repeated at the gradation levels higher than the level 37. For example, the subfield SF17 is on ("1") at the gradation level 20 and higher, and the subfield SF16 is on ("1") at the gradation level 36 and higher.

Furthermore, in FIG. 3, as shown in the range from gradation level 1 to 10, the subfield which is turned on ("1") at a lower gradation level is shifted by 2 subfields or more from the subfield having the shortest subfield period towards that having the longest subfield period, and the subfield having the longest subfield period which is on ("1") at a certain gradation level is continuously turned on at gradation levels higher than the certain gradation level. For example, the subfield SF19 is on ("1") at the gradation level 2 and higher, and the subfield SF18 is on ("1") at the gradation level 6 and higher (the sign "1" being omitted at levels 7 to 9 and levels 11 to 19 for brevity).

In FIG. 2, when the digital video signal is supplied, the subfield converter 10 converts its pixel signal corresponding to each pixel into a 19-subfield signal having a predetermined display period for each subfield. In detail, the subfield converter 10 accesses the look-up table, such as shown in FIG. 3, stored in the look-up memory 12, to divide the digital video signal into a given number of subfields, 19subfields in this embodiment.

Physical addresses are appointed when an external write-control address signal is supplied to the subfield converter 10. Data stored in the look-up table of the look-up memory 12 are then written in the first and second frame memories 14 and 16 at the appointed physical addresses. The first and second frame memories 64 and 66 consist of 19 subfield memories (not shown), corresponding to the 19 subfields, to store subfield data for 640×480 pixels Px, for example.

The data stored in the subfield memories are read, for example per 20 bits, and stored in the shift registers SR1 to SR 20. The data are transferred and stored, per 20 bits, in the shift registers DSR1 to DSR 20 of the display unit 4. The data are further transferred to memories (not shown) of the first row of pixels. Data transfer is continued for the second, the third, . . . , and the 480th row of pixels for one subfield. On completion of data transfer for the first subfield and data storage in the memories of all the rows of pixels, liquid-cystal driving voltages are simultaneously applied to all the pixels in accordance with the data stored in the memories of all the rows of pixels, to simultaneously drive the liquid crystals of all the pixels.

The same operation is continued for the second, the third, . . . , and the 19th subfield to complete displaying for one field.

While data are read out from the first frame memory 14, other data are written in the second frame memory 16 from the subfield converter 10. On completion of data read from the first frame memory 14 for one field, other one-field data are read from the second frame memory 16. Thereafter, write and read operations in and from the first and second frame memories 14 and 16 are alternately performed per field.

Discussed next is how pseudo contour effects can be reduced by used of the look-up-table shown in FIG. 3.

Subfields to be turned on, or for which a moving-picture image is displayed must be dose to each other for avoiding pseudo contour effects. For example, in FIG. 1C, while the gradation varies from the level 127 to 128, the subfields SF8 to SF 11 are turned off whereas the subfield SF17 is turned on, thus brightness varying from the level 127 to 143 even if the shift of viewer's line of vision is slow, which often causes pseudo contour effects. In contrast, when the subfield SF12 is turned on instead of SF17, as illustrated in FIG. 1B, brightness does not vary from the level 127 to 143 unless the shift of viewer's line of vision is quick (to the position S4) such as indicated by the light Y4, thus pseudo contour effects rarely occur.

Figure 1A:
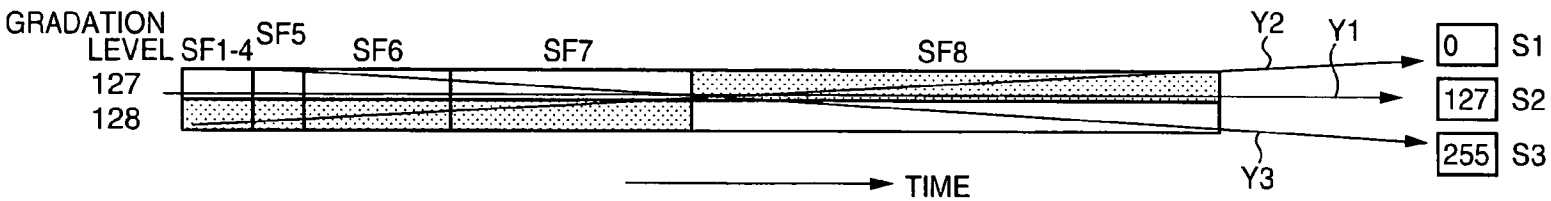
FIG. 1A PRIOR ART
FIG. 1A illustrates occurrence of pseudo contour effects.
Figure 1B:
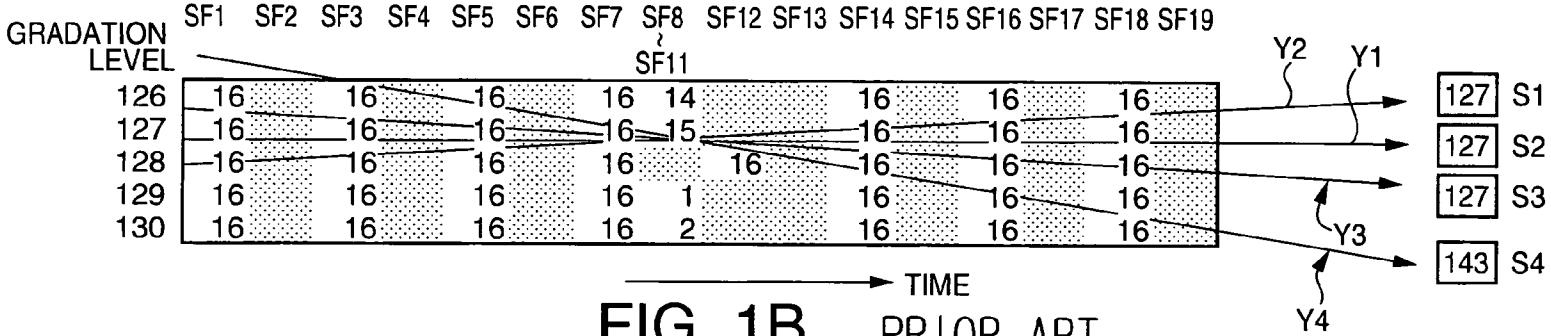
FIG. 1B PRIOR ART
FIG. 1B illustrates reduction of pseudo contour effects in a known display apparatus.
Figure 1C:
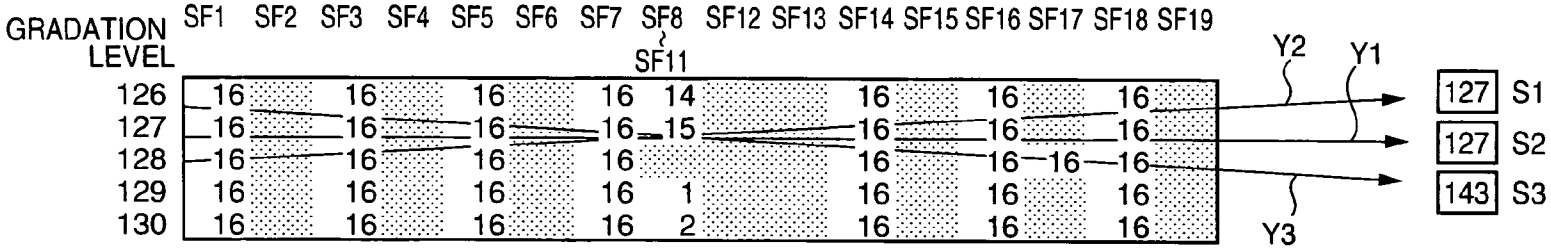
FIG. 1C PRIOR ART
FIG. 1C illustrates drawbacks in known display apparatuses in reduction of pseudo contour effects.

Moreover, in FIGS. 1B and 1C, the brightness level 15 is gained while the subfields SF8 to SF 11 are turned on at the gradation level 127 with the center of emission for the subfields SF8 to SF 11 being located between the subfields SF9 and SF 10. The shift of the center of emission cannot be minimized when the subfield SF12 is turned on at the gradation level 128. The center of emission means an average location (SF) of brightness for several subfields.

When brightness is set at the level 15 only for the subfield SF11, the center of emission is shifted from the subfields SF11 to SF 12 while the gradation varies from the level 127 to 128. Thus, the shift of the center of emission can be minimized to 1 subfield. The shift from one subfield to another can be minimized as difference in display period between subfields at successive gradation levels is smaller, although the display period for each subfield depending on the required gradation level.

It is thus concluded that the following are the two requirements for displaying moving-picture images at correct gradations with less pseudo contour effects.

(1) Difference in display period among subfields as small as possible; and (2) Shift of the center of emission among subfields as small as possible at successive gradation levels.

The look-up table shown in FIG. 3 meets the two requirements. As disclosed above, in the look-up table shown in FIG. 3, the subfield period becomes longer as the number of the subfields increases. The difference in subfield period between successive subfields is 30 microseconds for the subfields having shorter subfield period (subfields SF1 to SF3), which is, however, shorter as 20 microseconds, 15 microseconds, 10 microseconds and 5 microseconds, as the subfield period becomes longer.

The difference in subfield period in this embodiment is made from the fact that, as shown in FIG. 4, the intensity of output light varies like S-shaped not linearly against the drive voltage (root-mean-square value) to the liquid crystal, thus, even if the total of subfield periods for several subfields is equal to a subfield period of a particular subfield, the output light is brighter for this particular subfield than the several subfields. Therefore, the difference in subfield period is required to be shorter as the number of subfields increases, for offering accurate gradation.

Disclosed next is the drive sequence starting from the gradation level 0. All the subfields are turned off at the gradation level 0, the reference for deciding the black level on the liquid crystal display. Based on the gradation level 0, each subfield is turned on or off for a required black level.

As shown in FIG. 4, the output-light intensity exhibits S-shaped characteristics against liquid-crystal driving voltage (root-mean-square value). This characteristics makes the subfields to be selectively turned on, as follows:

At the gradation level 1, a subfield having a relatively long subfield period, such as the subfield SR9, is turned on.

At the gradation level 2 and higher, the subfield SR19 having the longest subfield period is turned on.

At higher gradation levels 3, 4, 5, . . . , the subfield to be turned on is shifted by a given number of subfields, such as, 4 subfields, from the subfields having shorter subfield period to those having longer subfield period. For example, In FIG. 3, the subfield SF4 is turned on at the gradation level 3, the subfield SF9 is on at the gradation level 4, and the subfield SF14 is on at the gradation level 5.

The number of "on"-, or "1"-subfields to be shifted is large, such as 4 subfields, as explained above, at lower successive gradation levels closer to the level (pure black), which is, however, not bright and hence not observed as pseudo contour effects.

The number of "on"-, or "1"-subfields is shifted by 1 subfield at the gradation levels 21 and higher, thus pseudo contour effects being reduced. The subfield SF16 is turned on (or no shift of "on"-, or "1"-subfield) at the gradation levels 36 and 37 while the subfield SF1 is turned on at the gradation level 37, with no pseudo contour effects being observed due to a short display period of the subfield SF1 (30 microseconds), by gradation adjustments. Not only the gradation levels 36 and 37, there are other successive gradation levels at which the "on"-, or "1"-subfield is not shifted while a subfield (other than the subfield SF1) having a short display period is turned on.

In FIG. 3, the difference in display period between successive subfields becomes shorter per several subfields as the display period becomes longer. For example, the difference in display period between the successive subfields SF1 and SF2 is 30 microseconds, which, however, becomes shorter as 20 microseconds, 15 microseconds, 10 microseconds and 5 microseconds, as the subfield period becomes longer as 90 microseconds, . . . , 190 microseconds, and so on.

Not only that, it is also preferable that the difference in display period between successive subfields becomes shorter per 1 subfield as the display period becomes longer. For example, the difference in display period between successive subfields may be shorter by 1.5 microseconds per 1 subfield as the display period for the subfields SF2, SF3, . . . , SF19 becomes longer as 58.5 microseconds, 85.5 microseconds, 111 microseconds, . . . , 313 microseconds, respectively, from 30 microseconds for the subfield SF1.

Which subfields are to be selected or turned on depends on the relationship between the drive voltage (root-mean-square value) for driving a display apparatus and output light intensity.

Moderate change from black, such as, a characteristic curve A1 shown in FIG. 4 requires subfield-drive sequence according to the look-up table shown in FIG. 3. In contrast, rapid change, such as, a characteristic curve A2 shown in FIG. 4 requires subfield-drive sequence according to a look-up table shown in FIG. 5 (a first modification which will be disclosed later).

As disclosed above, the embodiment according to the present invention employs the look-up table shown in FIG. 3 in which shift of the center of emission is small even if the gradation level varies, thus drastically reducing pseudo contour effects.

Figure 6:
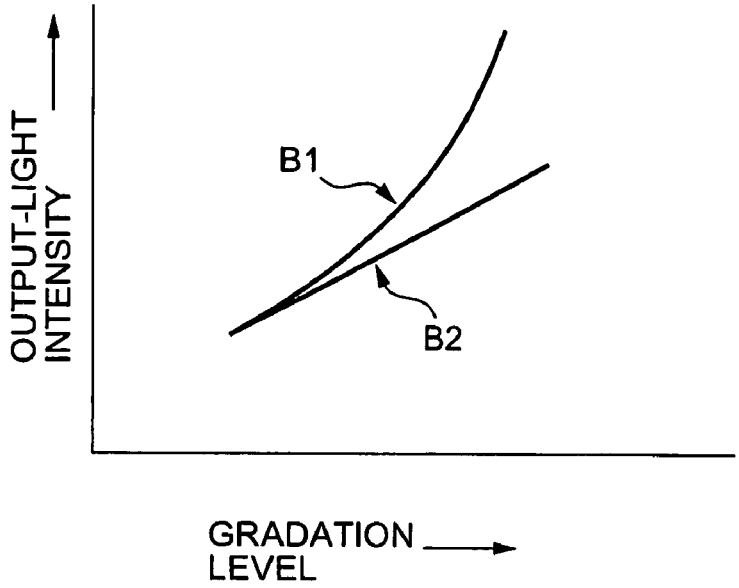
FIG. 6 shows change in output-light intensity against gradation level.

Shift of the subfield to be turned on always per 1 subfield, like those at the gradation levels 21 to 36 in FIG. 3, but with no change in display period at successive gradation levels in a liquid crystal display causes unfavorable output light intensity exhibiting quadratic-curve-like characteristics B1 rising upwards, such as shown in FIG. 6.

Such quadratic-curve-like characteristics can be corrected to linear characteristics B2, such as shown in FIG. 6, by employing the lookup table shown in FIG. 3 in which difference in display period is smaller per several subfields.

Moreover, in FIG. 3, the display period becomes longer as the number of subfields becomes larger in order of display, thus a displayed moving picture is protected from blurring which could, otherwise, be blurred due to decrease in resolution of the picture when it moves even though resolution is high when it stays.

Blurring of moving pictures often occurs in liquid crystal displays whereas it is rare in CRT displays due to hold emission pattern for the former but impulse emission pattern for the latter.

Figure 7:
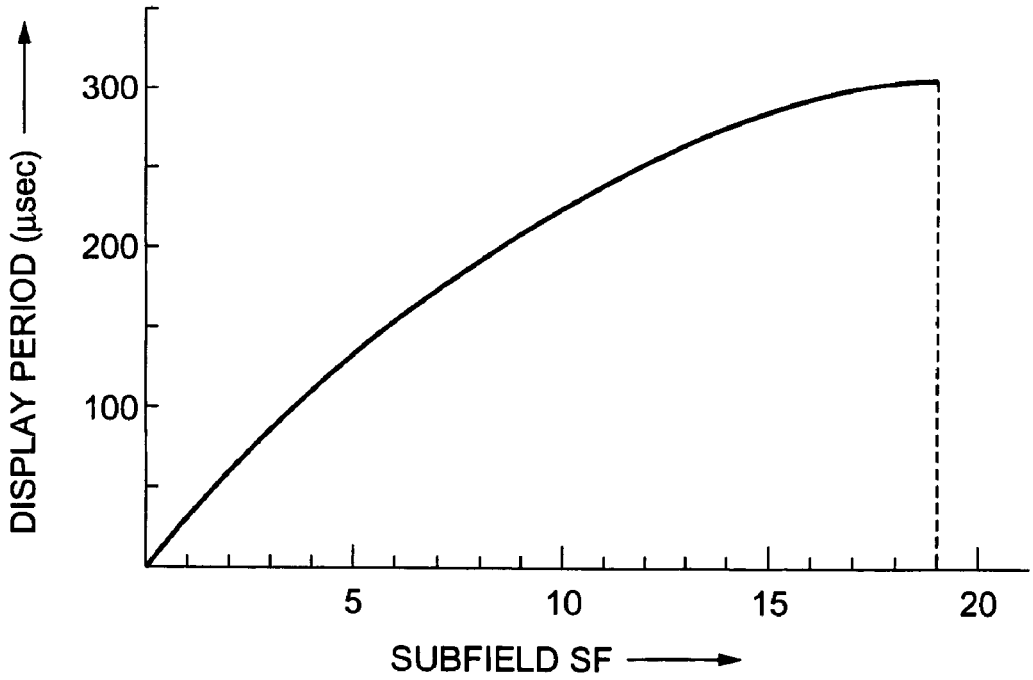
FIG. 7 shows change in display period against subfield number in the look-up table shown in FIG. 3.

Such blurring of moving pictures can be markedly prevented by use of the look-up table shown in FIG. 3 in which the display period becomes longer as the number of subfields increases and ends at a peak or a longest period, as shown in FIG. 7.

Disclosed next are several modifications to the look-up table shown in FIG. 3, that are preferably stored in the look-up memory 12 shown in FIG. 2.

[First Modification]

Shown in FIG. 5 is a first modification to the look-up table in FIG. 3. The first modification is applicable to rapid change in output light intensity such as the characteristic curve A2 shown in FIG. 4, as already mentioned.

The difference between the first modification and the look-up table (FIG. 3) is that the subfield to be turned on is shifted by 1 subfield at low gradation levels close to the black level in the first modification.

It is the same for the first modification and the look-up table (FIG. 3) that the display period becomes longer as the number of the subfields increases in order of display and the difference in display period becomes smaller per several subfields as the display period becomes longer.

In detail, in the look-up table shown in FIG. 5, the subfield to be turned on is shifted by 1 subfield at gradation levels 21 and higher to reduce pseudo contour effects. The subfield SF15 is turned on (or no shift of "on"-, or "1"-subfield) at the gradation levels 34 and 35 while the subfield SF1 is turned on at the gradation level 35, with no pseudo contour effects being observed due to a short display period of the subfield SF1 (30 microseconds), by gradation adjustments. The same is true at the gradation levels 36 and 37. There are other successive gradation levels at which the "on"-, or "1"-subfield is not shifted while a subfield (other than the subfield SF1) having a short display period is turned on.

Therefore, like the look-up table shown in FIG. 3, the first modification can markedly reduce pseudo contour effects.

[Second Modification]

Shown in FIG. 8 is a second modification to the look-up table in FIG. 3. The second modification is different from the first modification (FIG. 5) in that the difference in display period is constant, for example, 20 microseconds over the subfields. The other table configurations are almost the same as the first modification.

The second modification is applicable to a display apparatus, such as, a plasma display in which the total of display periods for all subfields correspond to the brightness on the plasma display panel, different from a liquid crystal display in which the difference in display period is required to be smaller as the display period becomes longer for successive subfields.

There are 19 subfields in the second modification, as shown in FIG. 8, from the first subfield SF1 having the shortest display period to the 19th subfield SF19 having the longest display period, with the constant difference in display period of 20 microseconds.

The subfield to be turned on is shifted by 1 subfield from the subfield SF1 to the subfield SF19 that is turned on at the gradation level 19 and higher. This drive sequence is repeated at higher gradation levels. Although not shown in FIG. 8, the subfield to be turned on is shifted by 2 or 3 subfields at intermediate gradation levels and higher.

At lower gradation levels, adjustments are made, for example, by error diffusion, to be feasible for a given gamma characteristics, so that the total of display periods for all subfields corresponds to the brightness.

The second modification of the look-up table is applicable to a display apparatus, such as, a plasma display apparatus, a digital mirror display apparatus, an electroluminescent display apparatus, and a field emission display apparatus.

It is the same for the look-up tables shown in FIGS. 3, 5 and 8 that the display period becomes longer as the number of subfields becomes larger in order of display.

However, it can be reversed, such that, the first subfield SF1 has the longest display period whereas the 19th subfield SF19 has the shortest display period, with the drive sequence in which the pattern of "1" progresses obliquely from the upper right to lower left, or from the subfields SF19 to SF1, which is the complete reverse version of the drive sequence shown in FIGS. 3, 5 and 8.

This reverse drive sequence also offers the same advantages as discussed above.

[Third Modification]

Shown in FIG. 9 is a third modification to the look-up table in FIG. 3. Subfields are divided into two groups, a first subfield group from the subfield SF1 to SF10 and a second subfield group from the subfield SF11 to SF19, aligned in order of display. The display period in the first subfield group becomes longer as the number of subfields becomes larger whereas that in the second subfield group is constant over the subfields. The display period in the first subfield group may be shorter as the number of subfields becomes larger.

In detail, the display period in the first subfield group becomes longer, such as, 30 microseconds, 60 microseconds, 90 microseconds, . . . , and 240 microseconds for the subfields SF1, SF2, SF3, . . . , and SF10, respectively, whereas that in the second subfield group is constant at 260 microseconds (the longest period) over the subfields SF11 to SF19.

Moreover, the difference in display period between successive subfields is adjusted as constant or smaller as the display period becomes longer. In detail, the difference in display period is constant at 30 microseconds between two successive subfields SF1 and SF2, SF2 and SF3, and SF3 and SF4 (the display period being relatively short for each subfield); constant at 20 microseconds between two successive subfields SF4 and SF5, SF5 and SF6, SF6 and SF7, SF7 and SF8, SF8 and SF9, SF9 and SF10, and SF10 and SF11 (the display period being relatively long for each subfield); and further constant at 0 microseconds between two successive subfields SF11 and SF12, SF12 and SF13, SF13 and SF14, SF14 and SF15, SF15 and SF16, SF16 and SF17, SF17 and SF18, and SF18 and SF19 (the display period being long for each subfield). In other words, the difference in display period between successive subfields becomes shorter, such as, 30 microseconds→20 microseconds→0 microseconds, as the display period becomes longer.

Furthermore, in FIG. 9, as the gradation level becomes higher from the level 1 to 10, the subfield to be turned on ("1") is shifted by 1 subfield from the subfield SF1 having the shortest display period towards the subfield SF10 having the longest display period in the first subfield group, followed by the subfield SF11 ("1") at the level 11, the closest to the first subfield group among the subfields in the second subfield group.

In the same way, as the gradation level becomes further higher, the subfield to be turned on ("1") is shifted by 1 subfield from the subfield SF1 having the shortest display period towards the subfield SF10 having the longest display period in the first subfield group, and also the subfield to be turned on ("1") is shifted by 1 subfield from the subfield SF11 the closest to the first subfield group towards the subfield SF19 the farthest from first subfield group among those in the second subfield group. Once the subfield the farthest from first subfield group, such as SF19, is turned on at a certain gradation level, it is continuously on at gradation levels higher than this level. The same drive sequence is repeated as the gradation level becomes higher.

The look-up table shown in FIG. 9 can also reduce the pseudo contour effects, as discussed below.

As disclosed, the display period becomes gradually longer as the number of the subfields is larger in the look-up table shown in FIG. 9. In addition, the difference in display period between successive subfields is 30 microseconds among the subfields SF1 to SF4 having relatively short display periods, which, however, becomes smaller as 20 microseconds and 0 microseconds (especially for the second subfield group) The difference in subfield period in this modification is made from the fact that, as shown in FIG. 4, the intensity of output light varies like S-shaped not linearly against the drive voltage (root-mean-square value) to liquid crystals, thus, even if the total of subfield periods for several subfields is equal to a subfield period of a particular subfield, the output light is brighter for this particular subfield than the several subfields. Therefore, the difference in subfield period is required to be smaller as the number of subfields increases, for offering accurate gradation.

Disclosed next is the drive sequence stating from the gradation level 0. All the subfields are turned off at the gradation level 0, the reference for deciding the black level on the liquid crystal display. Based on the gradation level 0, each subfield is turned on or off for a required black level.

As the gradation level becomes higher as 1, 2, and so on, the subfield to be turned on ("1") is shifted by 1 subfield. The display period is constant at 260 microseconds after the subfield SF11 is turned on, followed by the subfields SF12, SF13, . . . , and SF19 (turned on but shifted by 1 subfield). The subfield SF1 is turned on again when the subfield SF12 is turned on at the gradation level 12. At gradation levels higher than 12, two subfields are simultaneously turned on, such as, SF2 and SF13; SF3 and SF14; and so on.

At the gradation levels lower than 29, the subfield to be turned on is shifted by 1 subfield, thus reducing pseudo contour effects. At the gradation levels 29 and 30, the subfield SF7 is continuously turned on (with no shift of subfield to be turned on). The subfield SF1 is also turned on at the gradation level 30. No pseudo contour effects are observed at the gradation levels 29 and 30 because the display period of the subfield SF1 is shorter or the shortest. This is also true at the gradation levels 31 and 32 and also other successive gradation levels at which the "on"-, or "1"-subfield is not shifted while a subfield (other than the subfield SF1) having a short display period is turned on.

The look-up table shown in FIG. 9 has the first subfield group for which the display period becomes gradually longer and the second subfield group for which the display period is constant, or the stretch of display period being stopped at a certain long length, such as 260 microseconds, otherwise causing difficulty in gradation control in a liquid crystal display. Nevertheless, the adjustments to stop the stretch of display period at certain long length lower brightness. In order to compensate for this lowering of brightness, a subfield having a short display period, such as, the subfield SF1 is turned on again when a subfield having a long display period, such as, the subfield SF12 is turned on. This drive sequence enables fine gradation control even at higher gradation levels.

Shift of the subfield to be turned on always per 1 subfield, like those at the gradation levels 1 to 19 in FIG. 9, but with the display period constant over the first and second subfield groups (different from this modification), in a liquid crystal display, causes unfavorable output light intensity exhibiting quadratic-curve-like characteristics B1 rising upwards, as shown in FIG. 6.

Such quadratic-curve like characteristics can be corrected to linear characteristics B2, as shown in FIG. 6, by employing the lookup table shown in FIG. 9 in which the difference in display period is smaller per several subfields.

As disclosed, shift of the center of emission is small even if the gradation level varies in the look-up table shown in FIG. 9, thus pseudo contour effects being drastically reduced.

Moreover, in FIG. 9, the display period becomes longer as the number of subfields becomes larger in order of display, thus a displayed moving picture is protected from blurring which could, otherwise, be blurred due to decrease in resolution of the picture when it moves even though resolution is high when it stays.

Such blurring of moving pictures can be markedly prevented by use of the look-up table shown in FIG. 9 in which the display period becomes longer as the number of subfields increases and ends at a peak or a longest period, like shown in FIG. 7.

In the look-up table shown in FIG. 9, the display period becomes gradually longer for the first subfield group whereas it is constant at the longest period for the second subfield group.

However, it can be reversed, such that, the display period is constant at the longest period for the first subfield group whereas the display period becomes gradually shorter for the second subfield group in which the subfield SF19 has the shortest display period, with the drive sequence in which the pattern of "1" progresses obliquely from the upper right to lower left, or from the subfields SF19 to SF1, which is the complete reverse version of the drive sequence shown in FIG. 9. This reverse drive sequence also offers the same advantages as discussed above.

Moreover, in the look-up table shown in FIG. 9, the difference in display period becomes shorter per several subfields as the display period becomes longer for the first subfield group. It may, however, be shorter per 1 subfield as the display period becomes longer, for example, shorter by 1 microseconds per 1 subfield in which the subfields SF1 has the display period of 30 microseconds, SF2 having 59 microseconds, SF3 having 87 microseconds, . . . , SF11 having 275 microseconds, . . . , and SF19 having 275 microseconds, with the same drive sequence shown in FIG. 9.

Furthermore, the difference in display period may be constant over the subfields in the first subfield group, for example, constant at 30 microseconds in which the subfields SF1 has the display period of 30 microseconds, SF2 having 60 microseconds, SF3 having 90 microseconds, . . . , SF11 having 330 microseconds, . . . , and SF19 having 330 microseconds, with the same drive sequence shown in FIG. 9.

The third modification of the look-up table is applicable to a display apparatus with a proportional relationship between subfield display period and brightness, such as, a plasma display apparatus, a digital mirror display apparatus, an electroluminescent display apparatus, and a field emission display apparatus, which achieves marked reduction of pseudo contour effects.

[Fourth Modification]

Shown in FIG. 10 is a fourth modification to the look-up table in FIG. 3. Subfields are divided into three groups, a first subfield group from the subfield SF7 to SF13, a second subfield group from the subfield SF1 to SF6, and a third subfield group from the subfield SF14 to SF19.

The groups are aligned in order of display, such as, the second subfield group→the first subfield group→the third subfield group. The first subfield group located in the middle consists of several subfields having relatively short display periods. The second subfield group located first consists of several subfields with one subfield having the longest display period, for example, 305 microseconds for the first subfield SF1, which gradually becomes shorter, by 1 subfield, such as, 300 microseconds, 295 microseconds, . . . , and 270 microseconds. The third subfield group located last consists of several subfields with one subfield having the longest display period, for example, 305 microseconds for the last subfield SF19, towards which the display period gradually becomes longer, by 1 subfield, such as, 270 microseconds, 280 microseconds, . . . , and 305 microseconds. The alignment in the third subfield group is a reverse version of that in the second subfield group on the display period (gradually longer for the former whereas gradually shorter for the latter), having complementary period lengths or an inverse proportional relationship.

Every display period in the first subfield group is shorter than that of the last subfield, such as SF 6, of the second subfield group. Moreover, the display periods of 220 microseconds, 60 microseconds, 150 microseconds, . . . , 90 microseconds and 220 microseconds for the subfields SF7, SF8, SF9, . . . , SF12 and SF13, respectively, in the first subfield group are all shorter than those of the second and third subfield groups. In addition, the display periods in the first subfield group are alternately longer and shorter from the subfields SF 7 to SF13.

The drive sequence, or the order of the subfields to be turned on ("1") in the look-up table shown in FIG. 10 is as follows:

In the first subfield group, one or more of subfields are turned on simultaneously from the subfield having the shortest display period towards that having the longest display period.

In the third subfield group, the subfield to be turned on is shifted by 1 subfield from the subfield having the shortest display period towards that having the longest display period. Once the subfield having the longest display period in the third subfield group is turned on at a certain gradation level, it is continuously turned on after gradation levels higher than this level, with one or more of subfields in the first subfield group being turned on again simultaneously from the subfield having the shortest display period towards that having the longest display period while the subfields in the second subfield group are turned on by 1 subfield so that the subfield to be turned on is shifted from the subfield having the shortest display period towards that having the longest display period.

Once the subfield having the longest display period in the second subfield group is turned on at a certain gradation level, it is continuously turned on after gradation levels higher than this level, with one or more of subfields in the first subfield group being turned on again simultaneously from the subfield having the shortest display period towards that having the longest display period. This drive sequence is repeated at higher gradation levels.

The look-up table shown in FIG. 10 can also reduce the pseudo contour effects, as discussed below.

In the look-up table shown in FIG. 10, one TV field is divided into three groups of subfields having different display periods. The first subfield group located in the middle consists of several subfields having relatively short display periods (the same period for some subfields). The second subfield group located first consists of several subfields with one subfield SF1 having the longest display period, from which the display period becomes gradually shorter by 1 subfield. The third subfield group located last consists of several subfields with one subfield SF19 having the longest display period, towards which the display period becomes gradually longer by 1 subfield.

In the first subfield group, one or a necessary number of subfields are turned on simultaneously for displaying at correct gradations.

The differences in display period in the second and third subfield groups are smaller than that in the first subfield group. The difference in subfield period in this modification is made from the fact that, as shown in FIG. 4, the intensity of output light varies like S-shaped not linearly against the drive voltage (root-mean-square value) to the liquid crystal, thus, even if the total of subfield periods for several subfields is equal to a subfield period of a particular subfield, the output light is brighter for this particular subfield than the several subfields. Therefore, the difference in subfield period is required to be shorter as the number of subfields increases, for offering accurate gradation. The display periods in the first subfield group are relatively short, thus giving small effects to gradations even though the difference in subfield period is relatively large.

Disclosed next is the drive sequence stating from the gradation level 0. All the subfields are turned off at the gradation level 0, the reference for deciding the black level on the liquid crystal display. Based on the gradation level 0, each subfield is turned on or off for a required black level.

As the gradation level becomes higher as 1, 2, and so on, one or more of subfields having shorter display periods in the first subfield group are turned on simultaneously. Shift of the subfield having a shorter display period minimizes the shift of the center of emission, thus pseudo contour effects being hardly observed at the successive gradation levels.

At the gradation level 11 and higher, the subfield SF14 of the third subfield group is turned on, followed by the subfields SF15, SF16, . . . that are sequentially turned on per increase of 1 gradation level. The subfield to be turned on is shifted by the least 1 subfield for the subfields having long display periods, which minimizes the shift of the center of emission, thus pseudo contour effects being hardly observed at the successive gradation levels.

In transit from the gradation levels 15 to 16, the subfield SF10 (the first subfield group) having the shortest display period is turned on, which minimizes the shift of the center of emission, thus pseudo contour effects being hardly observed at the successive gradation levels.

At the gradation level 17, the subfield SF19 of the third subfield group is turned on, which is continuously turned on at gradation levels higher than 17. At the gradation level 18 and higher, one or more of subfields having shorter display periods in the first subfield group are turned on again simultaneously.

At the gradation level 30 and higher, the subfield SF6 of the second subfield group is turned on, followed by the subfields SF5, SF4, . . . that are sequentially turned on per increase of 1 gradation level. The subfield to be turned on is shifted by the least 1 subfield for the subfields having long display periods, which minimizes the shift of the center of emission, thus pseudo contour effects being hardly observed at the successive gradation levels.

At the gradation level 35, the subfield SF1 of the second subfield group is turned on, which is continuously turned on at gradation levels higher than 35, with one or more of subfields having shorter display periods in the first subfield group being turned on again simultaneously. The drive sequence is repeated at further higher gradation levels.

As disclosed, the look-up table shown in FIG. 10 minimizes the shift of the center of emission even the gradation level varies, thus markedly reducing pseudo contour effects.

Moreover, as disclosed, the look-up table shown in FIG. 10 has the subfield alignment with the second subfield group located first with the display period being shorter as the number of subfields increases from the subfield having the longest display period; the first subfield group located middle with the subfield having relatively short display periods; and the third subfield group located last with the last subfield having the longest display period towards which the display period is longer as the number of subfields increases, thus reducing pseudo contour effects and also flickers.

Shift of the subfield to be turned on always per 1 subfield, but with the display period constant, in a liquid crystal display, causes unfavorable output light intensity exhibiting quadratic-curve-like characteristics B1 rising upwards, as shown in FIG. 6.

Such a quadratic-curve like characteristics can be corrected to linear characteristics B2, as shown in FIG. 6, by employing the lookup table shown in FIG. 10 in which the difference in display period is smaller per several subfields in the second and third subfield groups.

In the look-up table shown in FIG. 10, the difference in display period becomes shorter per several subfields as the display period becomes longer in the third subfield group.

The difference in display period can, however, be constant over the subfields in the third subfield group, for example, constant at 10 microseconds with the subfield SF 14 having the display period of 270 microseconds, SF15 having 280 microseconds, SF16 having 290 microseconds, . . . , and SF19 having 320 microseconds.

Also in the second subfield group, the difference in display period becomes shorter per several subfields as the display period becomes longer. The difference in display period can, however, be constant over the subfields in the second subfield group, for example, constant at 10 microseconds with the subfield SF1 having the display period of 320 microseconds, SF2 having 310 microseconds, SF3 having 300 microseconds, . . . , and SF6 having 270 microseconds.

The drive sequence shown in FIG.10 is applicable to such variations of the second and third subfield groups.

The fourth modification of the look-up table is applicable to a display apparatus with a proportional relationship between subfield display period and brightness, such as, a plasma display apparatus, a digital mirror display apparatus, an electroluminescent display apparatus, and a field emission display apparatus, which achieves marked reduction of pseudo contour effects.

[Fifth Modification]

Shown in FIG. 11 is a fifth modification to the look-up table in FIG. 3. Subfields are divided into three groups, a second subfield group, a first subfield group and a third subfield group aligned in order of display.

The display period of subfields in the second and the third subfield group is constant and the longest among display periods over the three groups. All display periods in the first subfield group are shorter than that in the second and the third subfield group. They are alternately shorter and longer towards the last subfield of the first subfield group.

Difference between the fourth modification (FIG. 10) and the fifth modification (FIG. 11) are as follows: In the former, the display period is varied in the range from 270 to 305 microseconds in the second and the third subfield group whereas in the latter it is constant, for example, at 290 microseconds in the corresponding subfield groups.

The display periods for the first subfield group in the fifth modification are the same as those in the corresponding subfield group the fourth modification.

As disclosed, the first subfield group located in the middle consists of several subfields having several relatively short display periods. The second subfield group located first consists of several subfields having the constant longest display period. The third subfield group located last consists of several subfields having the constant longest display period.

The "on"/"off" pattern in the drive sequence for the fifth modification is almost the same as that for the fourth modification. The drive sequence, or the order of the subfields to be turned on ("1") in the look-up table shown in FIG. 11 is as follows:

In the first subfield group, one or more of subfields are turned on simultaneously from the subfield having the shortest display period towards that having the longest display period.

At higher gradation levels, the subfield to be turned on in the third subfield group is shifted by 1 subfield from the first subfield (SF14) towards the last subfield (SF19). Simultaneously with this, one or more of subfields in the first subfield group are turned on simultaneously from the subfield having the shortest display period towards that having the longest display period.

Once the subfield, such as SF19 of third subfield group, the farthest from the first subfield group is turned on at a certain gradation level, such as the level 17, it is continuously turned on after gradation levels higher than this level.

At higher gradation levels, the subfield to be turned on in the second subfield group is shifted by 1 subfield from the last subfield (SF6) towards the first subfield (SF1), with one or more of subfields in the first subfield group being turned on again simultaneously from the subfield having the shortest display period towards that having the longest display period.

Once the subfield, such as SF1 of the second subfield group, the farthest from the third subfield group is turned on at a certain gradation level, such as the level 30, it is continuously turned on after gradation levels higher than this level. This drive sequence is repeated at higher gradation levels.

Like the former modifications, the subfields are adjusted for several gradation levels in this modification under consideration that, even if the total of subfield periods for several subfields is equal to a subfield period of a particular subfield, the output light is brighter for this particular subfield than the several subfields.

In FIG. 11 all the subfields are turned off at the gradation level 0, the reference for deciding the black level on the liquid crystal display. Based on the gradation level 0, each subfield is turned on or off for a required black level.

As the gradation level becomes higher as 1, 2, and so on, one or more of subfields having shorter display periods in the first subfield group are turned on simultaneously. Shift of the subfield having a shorter display period minimizes the shift of the center of emission, thus pseudo contour effects being hardly observed at successive gradation levels.

At the gradation level 12 and higher, the subfield SF14 of the third subfield group is turned on, followed by the subfields SF15, SF16, . . . that are sequentially turned on per increase of 1 gradation level, with one or more of subfields having shorter display periods in the first subfield group being turned on again simultaneously. The subfield to be turned on is shifted by the least 1 subfield for the subfields having long display periods, which minimizes the shift of the center of emission, thus pseudo contour effects being hardly observed at the successive gradation levels.

At the gradation level 17, the subfield SF19 of the third subfield group is turned on, which is continuously turned on at gradation levels higher than 17. At the gradation level 25, the subfield SF6 of the second subfield group is turned on. At the gradation levels 26 and higher, the subfield to be turned on in the second subfield group having the longest display period is shifted by 1 subfield from the subfield SF6 towards SF1, with one or more of subfields having shorter display period in the first subfield group being turned on again simultaneously. This drive sequence is repeated at higher gradation levels.

Figure 12:
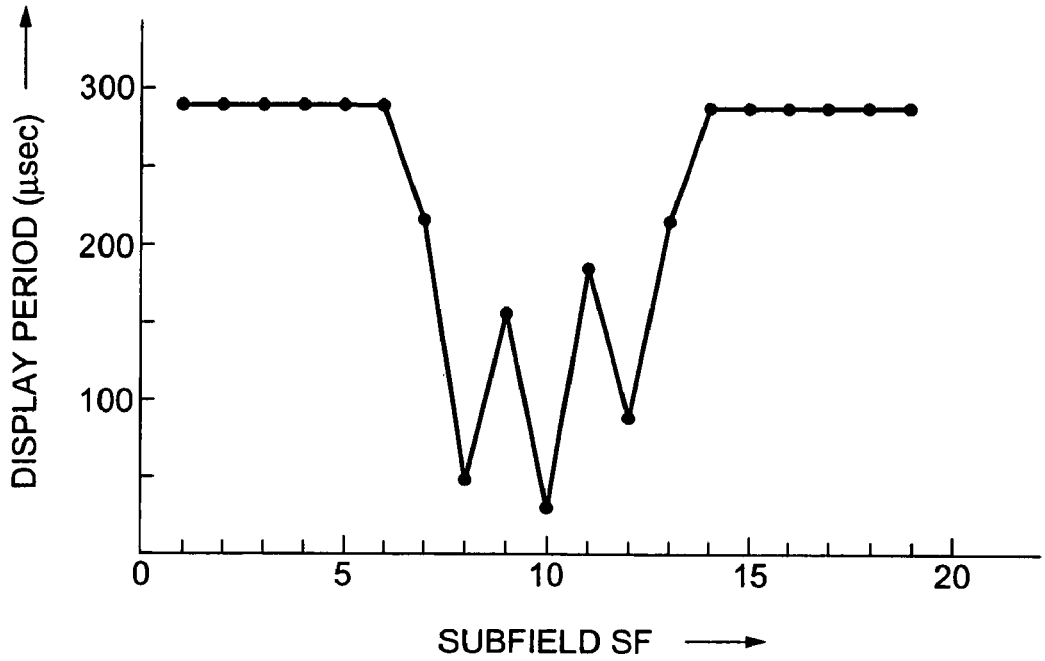
FIG. 12 shows change in display period against subfield number in the fifth modification.

Illustrated in FIG. 12 is change in display period against subfield numbers in this modification. Change in display period having two flat peaks shown on both sides can reduce pseudo contour effects and also flickers.

As disclosed, the fifth modification offers the same advantages as the fourth modification. Moreover, the fifth modification of the look-up table is applicable to a display apparatus with a proportional relationship between subfield display period and brightness, such as, a plasma display apparatus, a digital mirror display apparatus, an electroluminescent display apparatus, and a field emission display apparatus, which achieves marked reduction of pseudo contour effects.

[Sixth Modification]

Shown in FIG. 13 is a sixth modification to the look-up table in FIG. 3. The sixth modification is a variation of the fourth modification shown in FIG.10. In detail, the sixth modification corresponds to the fourth modification in a way that the subfields of the first subfield group are dispersed into the second and third groups in FIG. 10. The signs SF1 to SF19 in SUBFIELD shown in FIG. 13 are newly given to the subfields in the sixth modification whereas the signs SF1, SF2, SF8, . . . , and SF19 in PROVISIONAL SUBFIELD are equivalent to those in the fourth modification shown in FIG. 10 in which the subfields of the first subfield group are dispersed into the second and third groups, for easy understanding of the sixth modification.

As shown in PROVISIONAL SUBFIELD, the first subfield group in the sixth modification consists of the subfields SF7 to SF13 including the subfield having the shortest display period among the subfields SF1 to SF19 and other subfields having relatively short display periods.

The second subfield group located first in order of display (excluding the subfields of the first subfield group) includes one subfield having the longest display period and other subfields for which the display period is gradually shorter per field. The third subfield group located last in order of display (excluding the subfields of the first subfield group) includes one subfield having the longest display period and other subfields for which the display period is gradually longer per field. The second and third subfield groups have complementary display periods each other or display periods in an inverse proportional relationship each other.

The subfields SF7 to SF13 (PROVISIONAL SUBFIELD) of the first subfield group are dispersed into the second and third groups as follows: the subfield SF8 inserted between the SF2 and SF3; SF12 between SF4 and SF5; SF11 between SF5 and SF6; SF9 between SF15 and SF16; SF10 between SF17 and SF18; and SF7 and SF13 between SF6 and SF14.

Theses subfields are renumbered as SF1 and SF19 (SUBFIELD) in order of display to constitute the look-up table shown in FIG. 13. In detail, the subfields (SUBFIELD) are aligned in this look-up table so that the total display period for the former half subfields including the second group and that for the latter half subfields including the third group are almost equal to each other, or one TV field is almost equally divided into the former half subfields and the latter half subfields.

As shown in FIG. 13, the total display period for the former half subfields SF1 to SF10 is 2290 microseconds and that for the latter half subfields SF11 to SF19 is 2140 microseconds, almost equal to each other.

When the total number of subfields is an even number, the subfields can be divided into an "n" number of former half subfields and also the "n" number of latter half subfields, with the total display period almost equal to each other.

In contrast, when the total number of subfields is an odd number, the subfields can be divided into an "n+1" number of former half subfields and also the "n+1" number of latter half subfields, with the total display period almost equal to each other.

The drive sequence as the gradation level becomes higher from the level 0 is the same as that of the fourth modification (FIG. 10), and thus reducing moving-picture pseudo contour effects, like the fourth modification.

In the look-up table shown in FIG. 13, the difference in display period in the third subfield group (PROVISIONAL SUBFIELD) becomes gradually shorter per several subfields as the display period becomes longer. The difference in display period may, however, be constant over the subfields of the third subfield group, for example, constant at 10 microseconds in which the subfield SF14 has the display period of 270 microseconds, SF15 having 280 microseconds, SF16 having 290 microseconds, . . . , and SF19 having 320 microseconds.

Likewise, the difference in display period in the second subfield group (PROVISIONAL SUBFIELD) becomes gradually shorter per several subfields as the display period becomes longer. The difference in display period may, however, be constant over the subfields of the second subfield group, for example, constant at 10 microseconds in which the subfield SF1 has the display period of 320 microseconds, SF2 having 310 microseconds, SF3 having 300 microseconds, and SF6 having 270 microseconds.

[Seven Modification]

Shown in FIG. 14 is a seven modification to the look-up table in FIG. 3. The seventh modification is a variation of the fifth modification shown in FIG. 11.

In detail, the seventh modification corresponds to the fifth modification in a way that the subfields of the first subfield group are dispersed into the second and third groups in FIG. 11. The signs SF1 to SF19 in SUBFIELD shown in FIG. 14 are newly given to the subfields in the sixth modification whereas the signs SF1, SF2, SF8, . . . , and SF19 in PROVISIONAL SUBFIELD are equivalent to those in fifth modification shown in FIG. 11 in which the subfields of the first subfield group. are dispersed into the second and third groups, for easy understanding of the sixth modification.

As shown in PROVISIONAL SUBFIELD, the first subfield group of the sixth modification consists of the subfields SF7 to SF13 including the subfield having the shortest display period among the subfields SF1 to SF19 and other subfields having relatively shorter display periods.

The second subfield group located first in order of display (excluding the subfields of the first subfield group) includes subfields for which the display period is constant and longer than the display periods of the first subfield group. The third subfield group located last in order of display (excluding the subfields of the first subfield group) includes subfields for which the display period is constant and longer than the display periods of the first subfield group.

The subfields of the first subfield group are dispersed into the second and third subfield groups so that their display periods are alternately shorter and longer in order of display.

In detail, the subfields SF7 to SF13 (PROVISIONAL SUBFIELD) of the first subfield group are dispersed into the second and third groups as follows: the subfield SF8 inserted between the SF2 and SF3; SF12 between SF4 and SF5; SF11 between SF5 and SF6; SF9 between SF15 and SF16; SF10 between SF17 and SF18; and SF7 and SF13 between SF6 and SF14.

In other words, since the display period is constant over the second and third subfield groups, when viewed from the entire sequence of subfields, the subfields SF7 to SF13 of the first subfield group are dispersed into several subfields having the constant display period, in the seventh modification.

Theses subfields are renumbered as SF1 and SF19 (SUBFIELD) in order of display to constitute the look-up table shown in FIG. 14. In detail, the subfields (SUBFIELD) are aligned in this look-up table so that the total display period for the former half subfields including the second group and that for the latter half subfields including the third group are almost equal to each other, or one TV field is almost equally divided into the former half subfields and the latter half subfields, like the sixth modification.

In the sixth and seventh modifications, the display period varies longer or shorter extensively over the sequence of subfields, thus reducing pseudo contour effects and also flickers, while offering stable temperature characteristics and brighter images on screen.

Figure 15:
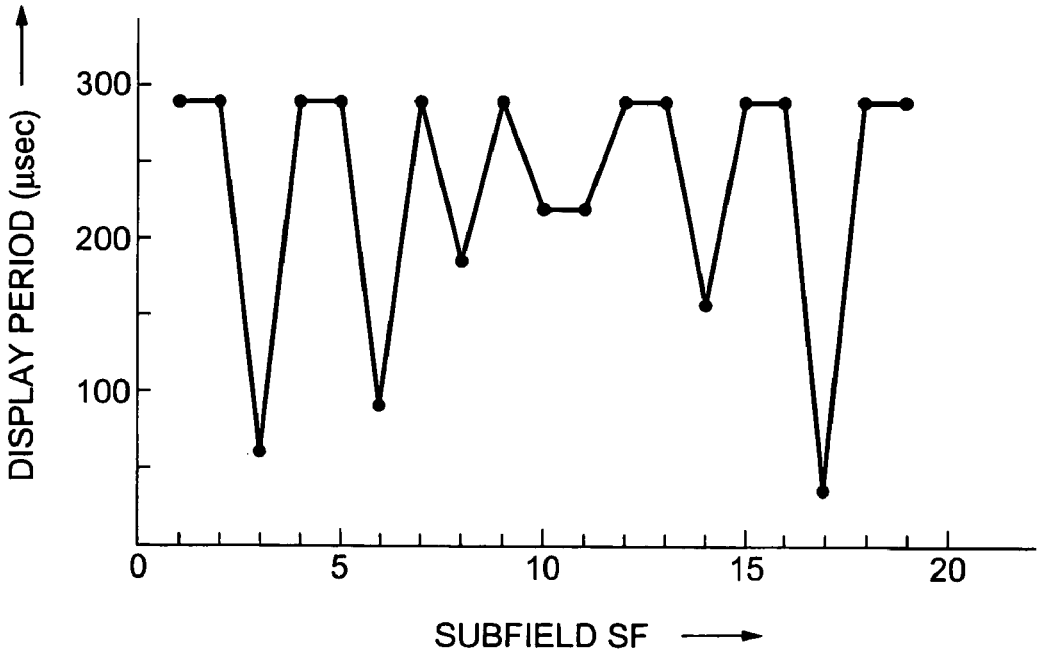
FIG. 15 shows change in display period against subfield number in the seventh modification.

Illustrated in FIG. 15 is change in display period against subfield numbers in the seventh modification. The display period varies up and down as the subfield numbers increase, which can reduce pseudo contour effects and flickers while offering stable temperature characteristics and brighter images on screen.

One TV field is divided into 19 subfields in the foregoing disclosure. It may, however, be divided into a larger or small number of subfields in the present invention.

As disclosed in detail, the display apparatus according to the present invention offers moving-picture images at fine gradations with less blur and pseudo contour effects.

What is claimed is:

1. A display apparatus comprising:

a display unit having a matrix of multiple pixels;

a divider to divide each of a plurality of fields of a digital input video signal into N number of subfields each subfield having a period shorter than a period of each field, N being a positive integer of two or larger;

a memory storing a look-up table to be used by the divider for dividing the field into the subfields, the look-up table listing data for selectively turning on and off the subfields in accordance with gradation levels of the digital video signal, an image being displayed on the display unit when the subfields are selectively turned on; and a driver to drive the pixels of the display unit per N number of subfields so that an image based on the digital input video signal is displayed on the display unit, wherein the data are arranged in the look-up table such that the N number of subfields are aligned from a first subfield to an N-th subfield in an image-displaying order, display periods of the subfields become longer from the first subfield towards the N-th subfield or from the N-th subfield towards the first subfield, a difference in display period between subfields adiacent to each other becomes smaller per at least one subfield as the display periods become longer, for specific gradation levels at which false contour effects have to be restricted, a specific subfield to be turned on is shifted by one subfield in the image-displaying order, or the specific subfield is kept on when the specific subfield is once turned on and one of subfields having shorter display periods than the specific subfield is turned on, per gradation-level change, for gradation levels except the specific gradation levels, a subfield to be turned on is shifted by at least one subfield in the image-displaying order, per gradation-level change, and wherein when a subfield having the longest display period among the N number of subfields is turned from off to on at a certain gradation level, the subfield thus turned on is kept on at gradation levels higher than the certain gradation levels.

2. A display apparatus comprising:

a display unit having a matrix of multiple pixels;

a divider to divide each of a plurality of fields of a digital input video signal into N number of subfields each subfield having a period shorter than a period of each field, N being a positive integer of two or larger;

a memory storing a look-up table to be used by the divider for dividing the field into the subfields, the look-up table listing data for selectively turning on and off the subfields in accordance with gradation levels of the digital video signal, an image being displayed on the display unit when the subfields are selectively turned on; and a driver to drive the pixels of the display unit per N number of subfields so that an image based on the digital input video signal is displayed on the display unit, wherein the data are arranged in the look-up table such that the N number of subfields are aligned from a first subfield to an N-th subfield in an image-displaying order, display periods of the subfields become longer from the first subfield towards the N-th subfield or from the N-th subfield towards the first subfield, a difference in display period between subfields adiacent to each other is constant over the N number of subfields, through the gradation levels, a specific subfield to be turned on is shifted by one subfield in the image-displaying order, or the specific subfield is kept on when the specific subfield is once turned on and one of the subfields having shorter display periods than the specific subfield is turned on per gradation-level change, and wherein when a subfield having the longest display period among the N number of subfields is turned from off to on at a certain gradation level, the subfield thus turned on is kept on at gradation levels higher than the certain gradation levels.

3. A display apparatus comprising:

a display unit having a matrix of multiple pixels;

a divider to divide each of a plurality of fields of a digital input video signal into a specific number of subfields each subfield having a period shorter than a period of each field;

a memory storing a look-up table to be used by the divider for dividing the field into the subfields, the look-up table listing data for selectively turning on and off the subfields in accordance with gradation levels of the digital video signal, an image being displayed on the display unit when the subfields are selectively turned on; and a driver to drive the pixels of the display unit per specific number of subfields so that an image based on the digital input video signal is displayed on the display unit, wherein the data are arranged in the look-up table such that the specific number of subfields are divided into a first subfield group and a second subfield group aligned in an image-displaying order, first subfields of the first subfield group are aligned from a first subfield to an N-th subfield in the image-displaying order, N being a positive integer of two or larger but smaller than the specific number, display periods of the first subfields becoming longer from the first subfield towards the N-th subfield whereas second subfields of the second subfield group that follows the first subfield group in the image-displaying order have a display period longer than the first subfields of the first subfield ground and constant over the second subfields, or the display periods of the first subfields of the first subfield group become longer from the N-th subfield towards the first subfield whereas the second subfields of the second subfield group that precedes the first subfield group in the image-displaying order have a display period longer than the first subfields of the first subfield ground and constant over the second subfields, through the gradation levels, a specific one subfield to be turned on or specific two subfields to be turned on are shifted by one subfield in the image-displaying order or the specific one subfield or the specific two subfields are kept on when once turned on and one of the subfields having shorter display periods than the specific subfield or the specific two subfields is turned on, per gradation-level change, and wherein when a subfield having the longest display period among all of the subfields in the first and second subfield groups is turned from off to on at a certain gradation level, the subfield thus turned on is kept on at gradation levels higher than the certain gradation level.

4. A display apparatus comprising:

a display unit having a matrix of multiple pixels;

a divider to divide each of a plurality of fields of a digital input video signal into a specific number of subfields each subfield having a period shorter than a period of each field;

a memory storing a look-up table to be used by the divider for dividing the field into the subfields, the look-up table listing data for selectively turn on and off the subfields in accordance with gradation levels of the digital video signal, an image being to be displayed on the display unit when the subfields are selectively turned on; and a driver to drive the pixels of the display unit per specific number of subfields so that an image based on the digital input video signal is displayed on the display unit, wherein the data are arranged in the look-up table such that the specific number of subfields are divided into a first subfield group, a second subfield group and a third subfield group aligned in an image-displaying order, the first subfield group preceding the second subfield group that precedes the third subfield group in the image-displaying order, first subfields of the first subfield ground are aligned from a first subfield to an N-th subfield in the image-displaying order, N being a positive integer of two or larger but smaller than the specific number, display periods of the first subfields becoming shorter from the first subfield towards the N-th subfield, third subfields of the third subfield group are aligned from a first subfield to an M-th subfield in the image-displaying order, M being a positive integer of two or larger but smaller than the specific number, display periods of the third subfields becoming longer from the first subfield towards the M-th subfield, and all of display periods of second subfields of the second subfield ground are shorter than a display period of the N-th subfield of the first subfield group and also a display period of the first subfield of the third subfield group, through the gradation levels, a specific one subfield to be turned on in the first subfield group is shifted by one subfield in the image-displaying order, or the specific subfield of the first subfield group is kept on when once turned on and one of the subfields in the second subfield group having a shorter display period than the specific subfield of the first subfield group is turned on, per gradation-level change, through the gradation levels, a specific one subfield to be turned on in the third subfield group is shifted by one subfield in the image-displaying order, or the specific subfield of the third subfield group is kept on when once turned on and one of the subfields in the second subfield group having a shorter display period than the specific subfield of the third subfield group is turned on, per gradation-level change, and wherein when a subfield having the longest display period in the first subfield ground is turned from off to on at a certain gradation level, the subfield thus turned on in the first subfield is kept on at gradation levels higher than the certain gradation level or when a subfield having the longest display period in the third subfield group is turned from off to on at a certain gradation level, the subfield thus turned on in the third subfield group is kept on at gradation levels higher than the certain gradation level.

5. A display apparatus comprising:

a display unit having a matrix of multiple pixels;

a divider to divide each of a plurality of fields of a digital input video signal into a specific number of subfields each subfield having a period shorter than a period of each field;

a memory storing a look-up table to be used by the divider for dividing the field into the subfields, the look-up table listing data for selectively turning on and off the subfields in accordance with gradation levels of the digital video signal, an image being displayed on the display unit when the subfields are selectively turned on; and a driver to drive the pixels of the display unit per specific number of subfields so that an image based on the digital input video signal is displayed on the display unit, wherein the data are arranged in the look-up table such that the specific number of subfields are divided into a first subfield group, a second subfield group and a third subfield group aligned in an image-displaying order, the first subfield group preceding the second subfield group that precedes the third subfield group in the image-displaying order, first subfields of the first subfield group have a display period constant over the first subfields, third subfields of the third subfield group have a display period constant over the third subfields, and second subfields of the second subfield group have display periods shorter than the display periods of the first and third subfields in the first and third subfield groups, respectively, through the gradation levels, a specific one subfield to be turned on in the first subfield group is shifted by one subfield in the image-displaying order per gradation-level change and at least one of the second subfields in the second subfield group is turned on when the specific one subfield of the first subfield group is shifted, through the gradation levels, a specific one subfield to be turned on in the third subfield group is shifted by one subfield in the image-displaying order oer gradation-level change and at least one of the second subfields in the second subfield ground is turned on when the specific one subfield of the third subfield group is shifted, and wherein when a subfield located first in the first subfield ground in the image-displaying order is turned from off to on at a certain gradation level, the subfield thus turned on in the first subfield group is kept on at gradation levels higher than the certain gradation level or when a subfield located last in the third subfield group in the image-displaying order is turned from off to on at a certain gradation level, the subfield thus turned on in the third subfield ground is kept on at gradation levels higher than the certain gradation level.

6. A display apparatus comprising:

a display unit having a matrix of multiple pixels;

a divider to divide each of a plurality of fields of a digital input video signal into a specific number of subfields each subfield having a period shorter than a period of each field;

a memory storing a look-up table to be used by the divider for dividing the field into the subfields, the look-up table listing data for selectively turning on and off the subfields in accordance with gradation levels of the digital video signal, an image being displayed on the display unit when the subfields are selectively turned on; and a driver to drive the pixels of the display unit per specific number of subfields so that an image based on the digital input video signal is displayed on the display unit, wherein the data are arranged in the look-up table such that the specific number of subfields are divided into a first subfield group, a second subfield group and a third subfield group, the second and third subfield groups being aligned in an image-displaying order, the second subfield group preceding the third subfield group in the image-displaying order second subfields of the second subfield group are aligned from a first subfield to an N-th subfield in the image-displaying order, N being a positive integer of two or larger but smaller than the specific number, display periods of the second subfields of the second subfield group becoming shorter from the first subfield towards the N-th subfield, first subfields of the first subfield group are dispersed into the second and third subfield groups and display periods of all of the first subfields are shorter than a display period of the N-th subfield of the second subfield group, third subfields of the third subfield group are aligned from a first subfield to an M-th subfield in the image-displaying order, M being a positive integer of two or larger but smaller than the specific number, display periods of the third subfields becoming longer from the first subfield to the M-th subfield, the first subfield of the second subfield group having the longest display period in the second subfield group is located at the ton of all of the subfields in the first, second and third subfield grounds whereas the M-th subfield of the third subfield ground having the longest display period in the third subfield group is located at the last of all of the subfields in the first, second, and third subfield groups, when all of the subfields in the first, second, and third subfield groups are divided into a former ground including the second subfield group and a latter group including the third subfield group in the image-displaying order, a total of the display periods in the former group and a total of the display periods in the latter group are almost equal to each other, through the gradation levels, a specific one subfield to be turned on in the second subfield group is shifted by one subfield in the image-displaying order, or the specific subfield of the second subfield is kept on when once turned on and one of the subfields in the first subfield group having a shorter display period than the specific subfield of the second subfield is turned on, per gradation-level change, through the gradation levels, a specific one subfield to be turned on in the third subfield group is shifted by one subfield in the image-displaying order, or the specific subfield in the third subfield group is kept on when once turned on and one of the subfields in the first subfield group having a shorter display period than the specific subfield of the third subfield group is turned on, per gradation-level change, and wherein when a subfield having the longest display period in the second subfield group is turned from off to on at a certain gradation level, the subfield thus turned on is kept on at gradation levels higher than the certain gradation level or when a subfield having the longest display period in the third subfield ground is turned from off to on at a certain gradation level, the subfield thus turned on is kept on at gradation levels higher than the certain gradation level.

7. A display apparatus comprising:

a display unit having a matrix of multiple pixels;

a divider to divide each of a plurality of fields of a digital input video signal into a specific number of subfields each subfield having a period shorter than a period of each field;

a memory storing a look-up table to be used by the divider for dividing the field into the subfields, the look-up table listing data for selectively turning on and off the subfields in accordance with gradation levels of the digital video signal, an image being to-be displayed on the display unit when the subfields are selectively turned on; and a driver to drive the pixels of the display unit per specific number of subfields so that an image based on the digital input video signal is displayed on the display unit, wherein the data are arranged in the look-up table such that the specific number of subfields are divided into a first subfield group, a second subfield ground and a third subfield group, the second and third subfield groups being aligned in an image-displaying order, the second subfield group preceding the third subfield group in the image-displaying order, second subfields of the second subfield group are aligned from a first subfield to an N-th subfield in the image-displaying order, N being a positive integer of two or larger but smaller than the specific number, display periods of the second subfields of the second subfield group being constant over the second subfields, third subfields of the third subfield group are aligned from a first subfield to an M-th subfield in the image-displaying order, M being a positive integer of two or larger but smaller than the specific number, display periods of the third subfields being constant over the third subfields, first subfields of the first subfield group are dispersed into the second and third subfield groups and display periods of all of the first subfields are shorter than the display periods of the second and third subfields of the second and third subfield groups, respectively, the first subfield of the second subfield group is located at the top of all of the subfields in the first, second and third subfield groups whereas the M-th subfield of the third subfield group is located at the last of all of the subfields in the first, second, and third subfield groups, when all of the subfields in the first, second, and third subfield grounds are divided into a former ground including the second subfield group and a latter group including the third subfield group in the image-displaying order, a total of the display periods in the former ground and a total of the display periods in the latter group are almost equal to each other, through the gradation levels, a specific one subfield to be turned on in the second subfield group is shifted by one subfield in the image-displaying order and at least one of the first subfields of the first subfield group is turned on when the specific one subfield of the second subfield group is shifted, per gradation-level change, through the gradation levels, a specific one subfield to be turned on in the third subfield ground is shifted by one subfield in the image-dissolving order and at least one of the first subfields of the first subfield ground is turned on when the specific one subfield of the third subfield group is shifted, per gradation-level change, and wherein when the first subfield located at the ton of all of the subfields in the first, second and third subfield grounds is turned from off to on at a certain gradation level, the first subfield thus turned on is kept on at gradation levels higher than the certain gradation level or when the M-th subfield located at the last of all of the subfields in the first, second and third subfield groups is turned from off to on at a certain gradation level, the M-th subfield thus turned on is kept on at gradation levels higher than the certain gradation level.

* * * * *

UNITED STATES PATENT AND TRADEMARK OFFICE

CERTIFICATE OF CORRECTION

PATENT NO. : 7,339,557 B2
APPLICATION NO. : 10/809616
DATED : March 4, 2008
INVENTOR(S) : Yutaka Ochi It is certified that error appears in the above-identified patent and that said Letters Patent is hereby corrected as shown below:

Column 21, Line 43 (Claim 1, line 25) – replace the word “adiacent” with --adjacent--

Column 22, Line 19 (Claim 2, line 25) – replace the word “adiacent” with --adjacent--

Column 22, Line 27 (Claim 2, line 33), insert a --,-- after the word “on”

Column 22, Line 66 (Claim 3, line 32), replace the word “ground” with --group--

Column 23, Line 7 (Claim 3, line 40), replace the word “ground” with --group--

Column 23, Line 47 (Claim 4, line 26), replace the word “ground” with --group--

Column 23, Line 59 (Claim 4, line 38), replace the word “ground” with --group--

Column 24, Line 13 (Claim 4, line 59), replace the word “ground” with --group--

Column 24, Line 63 (Claim 5, line 42), replace the word “oer” with --per--

Column 24, Line 65 (Claim 5, line 44), replace the word “ground” with --group--

Column 25, Line 2, replace the word “ground” with --group--

Column 25, Line 9, replace the word “ground” with --group--

Column 25, Line 55, replace the word “ton” with --top--

Column 25, Line 56, replace the word “grounds” with --groups--

Column 25, Line 57, replace the word “ground” with --group--

Column 25, Line 62, replace the word “ground” with --group--

Column 26, Line 22 (Claim 6, line 78), replace the word “ground” with --group--

Column 26, Line 36 (Claim 7, line 11), delete “to-be”

Column 26, Line 46 (Claim 7, line 20), replace the word “ground” with --group--

Column 27, Line 7 (Claim 7, line 48), replace the word “grounds” with --groups--

Column 27, Line 7 (Claim 7, line 48), replace the word “ground” with --group--

UNITED STATES PATENT AND TRADEMARK OFFICE

CERTIFICATE OF CORRECTION

PATENT NO. : 7,339,557 B2
APPLICATION NO. : 10/809616
DATED : March 4, 2008
INVENTOR(S) : Yutaka Ochi It is certified that error appears in the above-identified patent and that said Letters Patent is hereby corrected as shown below:

Column 27, Line 11 (Claim 7, line 52), replace the word “ground” with --group--

Column 28, Line 2 (Claim 7, line 61), replace the word “ground” with --group--

Column 28, Line 3 (Claim 7, line 62), replace the words “image-dissolving” with --image-displaying--

Column 28, Line 4 (Claim 7, line 63), replace the word “ground” with --group--

Column 28, Line 7 (Claim 7, line 66), replace the word “ton” with --top--

Column 28, Line 9 (Claim 7, line 68), replace the word “grounds” with --groups--

Signed and Sealed this

Twenty-second Day of July, 2008

JON W. DUDAS
*Director of the United States Patent and Trademark Office*